US006089149A

United States Patent [19]

Zelko

[11] Patent Number: 6,089,149

[45] Date of Patent: Jul. 18, 2000

[54] SCREEN PRINTING MACHINES

[76] Inventor: Steve Zelko, 1373 Kebed Way, Port Coquitlam, British Columbia, Canada, V3C 6G1

[21] Appl. No.: 09/076,821

[22] Filed: May 13, 1998

[51] Int. Cl.[7] ..... B41F 15/04

[52] U.S. Cl. ..... 101/115; 101/126

[58] Field of Search ..... 101/35, 43, 44, 101/114, 115, 123, 126, 129

[56] References Cited

U.S. PATENT DOCUMENTS 4,909,146 3/1990 Szarka ..... 101/126

5,031,527 7/1991 Eppinger ..... 101/115

*Primary Examiner*—Ren Yan

[57] ABSTRACT

A screen printing machine has article supports for articles to be printed, a displacement mechanism for displacing the article supports in succession around an endless path of travel and printing stations distributed along the path of travel and each having a printing head. The displacement mechanism has drive members engageable with the article supports for displacing the article supports, a reciprocating drive operable to reciprocate the drive members to and fro along the endless path to advance the articles in succession to the printing stations, and actuating devices for displacing the drive members into and out of engagement with the article supports.

26 Claims, 21 Drawing Sheets

SCREEN PRINTING MACHINES

BACKGROUND OF THE INVENTION

1. Field of the Invention

The present invention relates to screen printing machines and, more particularly, to screen printing machines of the type which employ a plurality of article supports, e.g pallets or vacuum tables, for carrying articles to be printed, the article supports being displaceable around an endless path in succession through a plurality of printing stations each provided with a printing head.

2. Description of the Related Art

It has previously been known to provide a screen printing machine of the above-mentioned type having an endless chain for pulling the article supports around the endless path. Since it is important to ensure that the articles to be printed, which are carried on the article supports, are accurately located in position at the printing stations beneath the printing heads, locating devices have been provided at the printing stations for engaging and accurately positioning the vacuum tables. One such screen printing machine is disclosed in my co-pending U.S. patent application Ser. No. 08/919,407, filed Sep. 29, 1997, the disclosure of which is incorporated herein by reference.

However, it is a substantial disadvantage of chain-driven printing machines that the drive chain, over the course of time, tends to stretch, causing inaccuracy and possible disruption of the printing process.

It is also well known in the art to employ vacuum tables for supporting paper, plastic and other articles, known as flat stock, as the vacuum tables are advanced from station to station around an endless path.

It is an object of the present invention to provide a printing machine having a novel and improved mechanism for displacing the article supports for the articles to be printed to successive printing stations.

BRIEF DESCRIPTION OF THE INVENTION

According to the present invention, a screen printing machine has a displacement mechanism which is provided for displacing a plurality of article supports in succession around an endless path of travel, with printing stations distributed along the path and each having a printing head. The displacement mechanism comprises drive members engageable with the article supports for displacing the article supports along the path, a reciprocating drive operable to reciprocate the drive members to and fro along the path and actuating devices for moving the drive members into and out of engagement with the article supports.

By the to-and-fro movement of the drive members, the article supports are advanced in succession to the printing stations, at which printing on the article supports is performed.

By using the reciprocating drive, the present invention avoids the disadvantages of prior art endless chain drives from displacing articles to successive printing stations.

The reciprocating drive preferably comprises elongate members and pivots connecting the elongate drive members, the elongate drive members and the pivots forming a drive connection between the prime mover and the drive members.

In a preferred embodiment of the invention, the endless path includes a pair of parallel elongate straight path sections, tracks extending along the straight path sections and a pair of carriages carried on the tracks, the drive members being mounted on the tracks and the reciprocating drive being connected to the carriages for displacing the carriages to and fro, in opposite directions, to one another, along the tracks.

The drive members are arranged in pairs spaced apart transversely of the path and each of the supports has leading and trailing pairs of projections to facilitate transfer of the article supports between the straight path sections.

BRIEF DESCRIPTION OF THE DRAWINGS

The present invention will be more readily understood from the following description thereof when taken in conjunction with the accompanying drawings, in which.

DESCRIPTION OF THE PREFERRED EMBODIMENT

Figure 1:
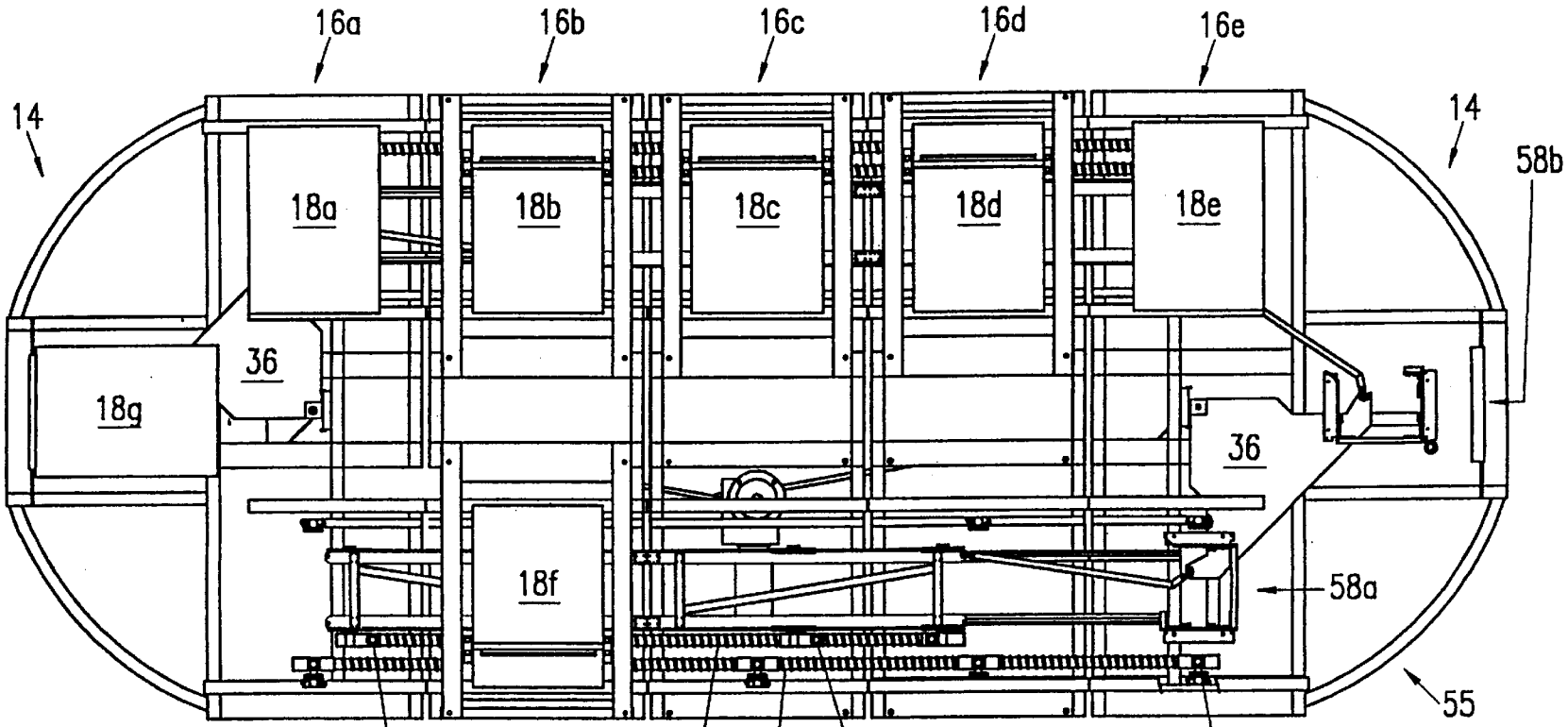
FIG. 1 shows a plan view of parts of a screen printing machine embodying the present invention.

Referring firstly to FIG. 1 of the accompanying drawings, there is shown a screen printing machine indicated generally by reference numeral 10, which is intended for printing flat stock and which has a machine frame indicated generally by reference numeral 12. The machine frame 12 has opposite end sections indicated generally by reference numerals 14 and intermediate sections indicated generally by reference numerals 16*a*–16*e*. Each of the intermediate sections 16*a*–16*e* has two printing stations, as described in more detail below. The number of these intermediate sections 16*a*–16*e* can be varied in order to correspondingly vary the number of printing stations in the screen printing machine.

FIG. 1 also shows seven article supports in the form of vacuum tables 18*a*–18*g* which, in operation of the machine, are advanced stepwise around a horizontal endless path, as will also be apparent from the following description, by means of a support displacement mechanism, components of which will now be described to reference FIGS. 2 through 4. The machine 10 is normally equipped with a further five similar vacuum tables, which have been omitted from the drawings in order to facilitate the illustration of the machine 10.

Figure 2:
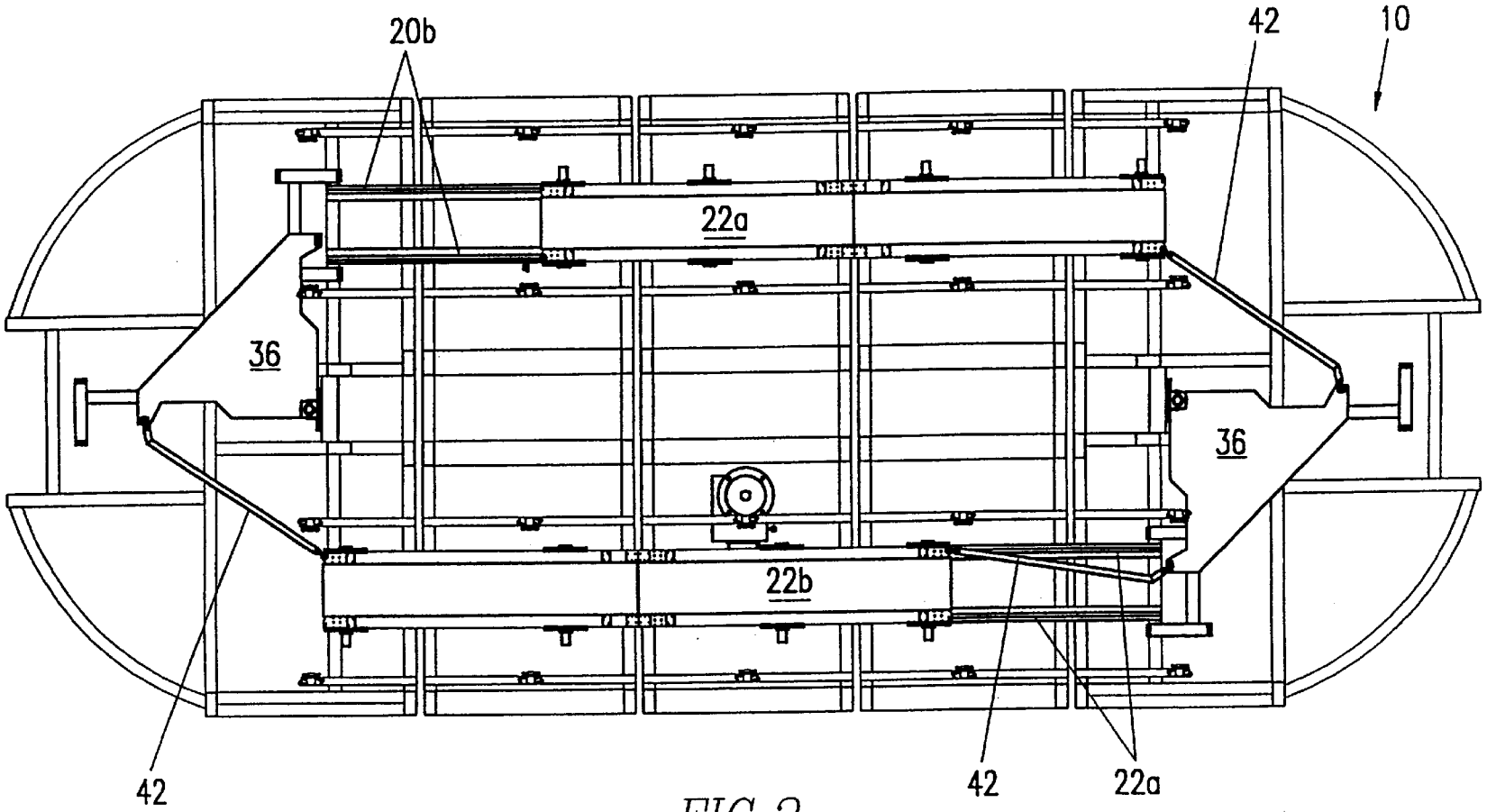
FIG. 2 shows a plan view corresponding to FIG. 1, but with some of the parts of the machine omitted.

The endless path of travel of the article supports 18*a*–18*g* through the screen printing machine 10 includes two parallel elongate straight path sections, each defined by a pair of rails 20*a*, 20*b* (FIG. 2). A pair of reciprocatable carriages 22*a*, 22*b* are mounted on the rails 20*a*, 20*b* for movement to and fro along the rails 20*a*, 20*b*. For this purpose, a reciprocating displacement mechanism is provided, which includes a prime mover in the form of an electric motor 24 (FIG. 4) which is mounted in the machine frame 12 and, more particularly, in the central intermediate section 16*c*. The electric motor 24 drives a gear box 26, containing a reduction gearing and the gear box 26, in turn, pivots a crank arm 28 to and fro. The crank arm 28 is connected by a first pair of connection rods 30 to a second pair of connection rods 32, with pivot connections 27 between the crank arm 28 and the connecting rods 30. Each connecting rod 30 is connected to its respective connecting rod 32 by means of a pivot connection 34, which is slidable along a rail 37 in a respective guide 38 fixedly secured to the machine frame 12.

Each connection rod 32 is connected, in turn, by a pivot connection 33 to a lever arm 35, which projects from a horizontally pivotable drive connector 36.

The crank arm 28, the connecting rods 30 and 32 and the lever arms 35 are thus elongate members which, with the pivot connections 27, 33 and 34, form a drive connection or linkage between the motor 34 and the drive connectors 36. The drive connectors 36 are each formed of a plate of generally triangular shape, which is pivotable to and fro in a horizontal plane about a vertical pivot axis of a respective pivot shaft 40 mounted on the machine frame 12. When the electric motor 24 is energized to cause the crank arm 28 to pivot to and fro, the drive connectors 36 are each pivoted horizontally through 90° to and fro about their respective pivot shafts 40 between the positions in which they are shown in FIG. 2 and the positions in which they are shown in FIG. 3.

Figure 3:
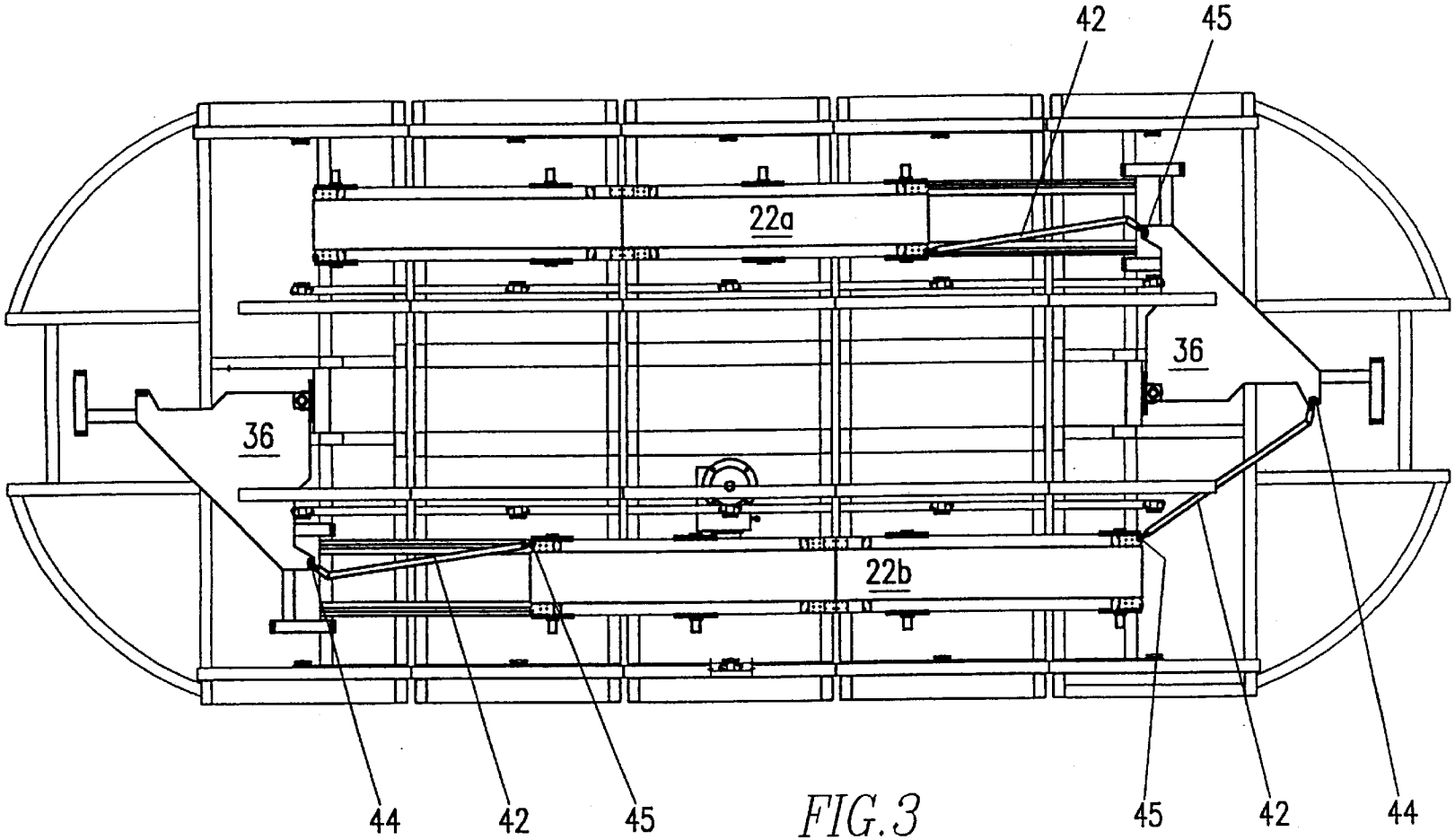
FIG. 3 shows a view corresponding to FIG. 2, but with parts of the machine moved into different positions.
Figure 4:
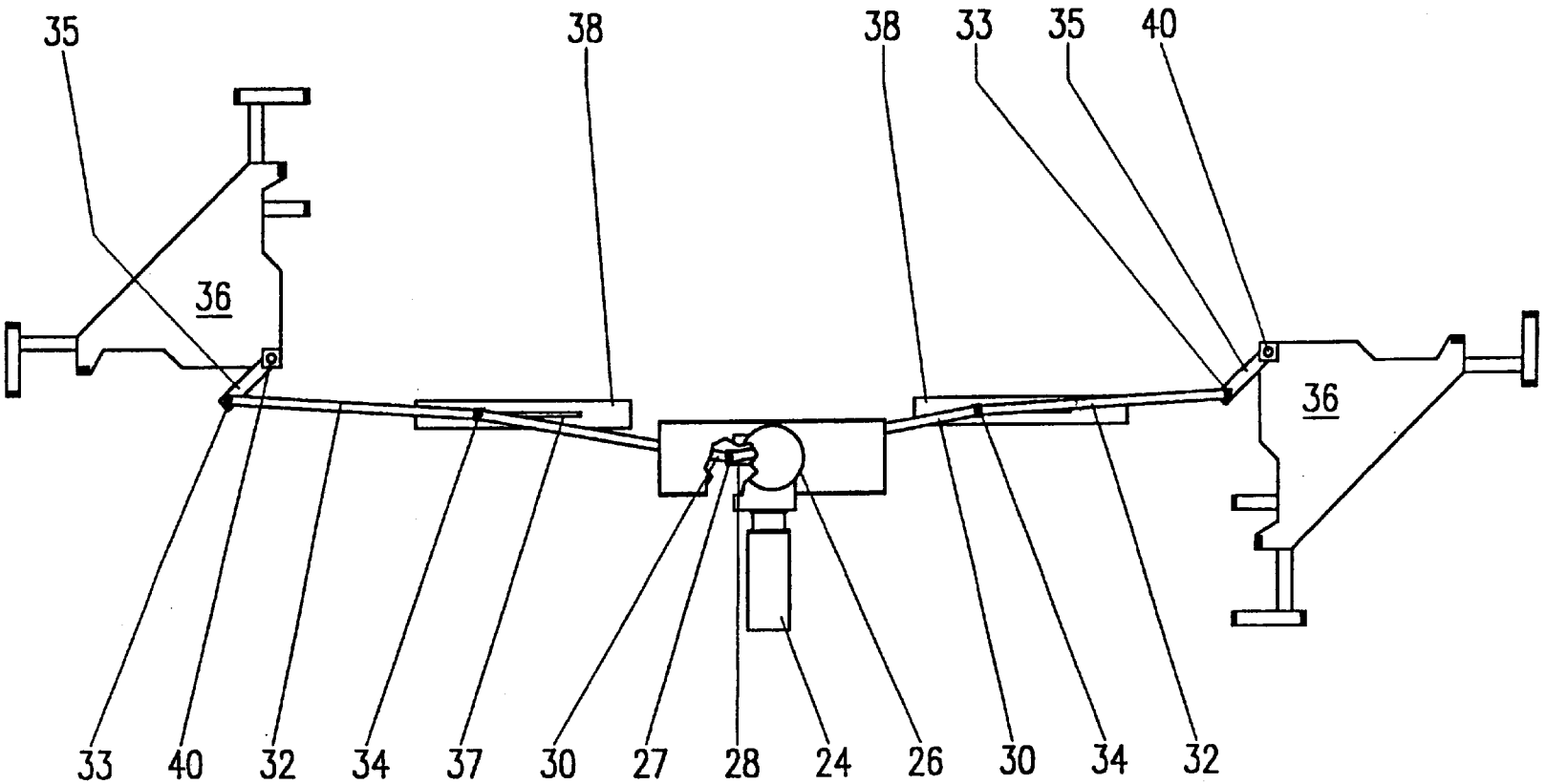
FIG. 4 shows a view corresponding to FIG. 2, but with further parts of the machine omitted to show components of an article support displacement mechanism.

As shown in FIGS. 2 and 3, the drive connectors 36 are connected by connecting rods or links 42 to the proximal ends of the reciprocatable carriages 22*a*, 22*b*. More particularly, the connecting rods 42 are connected by pivot connections 44 to the drive connectors 36 and by pivot connections 45 to the reciprocatable carriages 22*a*, 22*b*. Consequently, as the drive connectors 36 are pivoted to and fro about their pivot axis 40, the carriages 22*a*, 22*b* are correspondingly displaced to and fro, in opposite directions to one another, along the rails 20*a*, 20*b*. Thus, the arrangement is such that, as will be apparent from FIGS. 2 and 3, the carriage 22*a* is moved to the right, as viewed in these figures, as the table 22*b* is moved to the left, and vice versa. These components drivingly connecting the electric motor 24 to the carriages 22*a*, 22*b* are all parts of the above-mentioned reciprocating displacement mechanism.

It will be noted that the left-hand drive connector 36, as viewed in FIGS. 2 and 3, has only one connecting rod 42, by which it is connected to the carriage 22*b*. The omission of any connecting rod 42 between this drive connector 36 and the carriage 22*a* facilitates the reciprocation of the two carriages 22*a* and 22*b*.

Each of these pivotations of the drive connectors 36 to and fro through 90° causes a corresponding reciprocation of the carriages 22*a*, 22*b* through a predetermined distance corresponding to the distance from one to the next of the printing stations at each side of the machine. In this way, the article supports are advanced in steps to successive ones of the printing stations, as described below.

Figure 5:
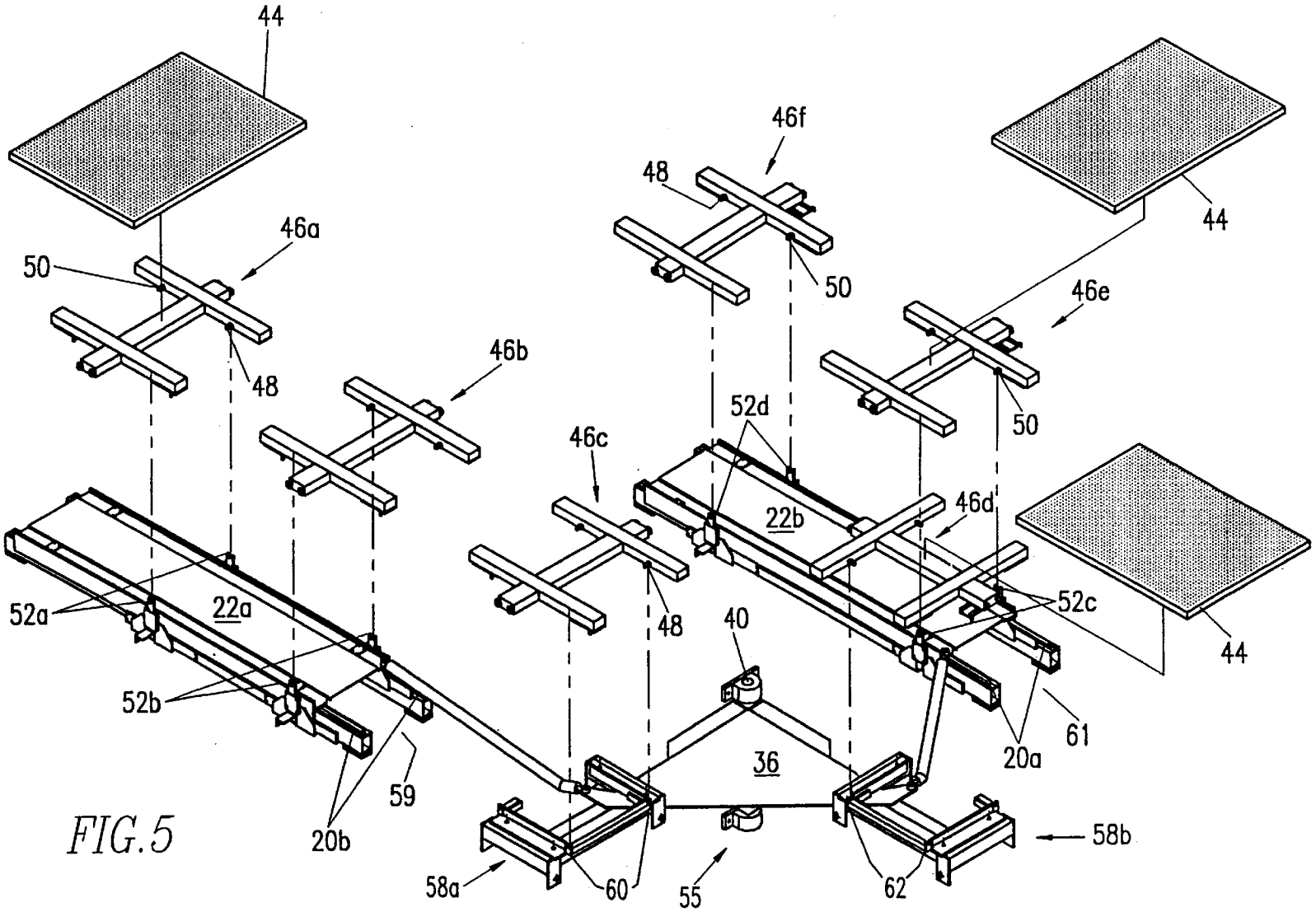
FIG. 5 shows an exploded view, in perspective, of components of the article support displacement mechanism of FIG. 4 and of article supports which are displaced by that mechanism.

FIG. 5 shows a broken-way exploded view of parts of the displacement mechanism and of the vacuum tables themselves.

More particularly, in FIG. 5, reference numerals 44 indicate three perforated table tops, the constructional details of which are described below. The table tops 44 are each fixedly secured to a respective generally H-shaped sub-structure, of which six are shown in FIG. 5 and indicated generally by reference numerals 46*a*–46*f*, and which are each provided with a pair of leading projections 48 and a pair of trailing projections 50. The carriages 22*a*, 22*b* are provided at opposite sides thereof with pairs of drive members, four pairs of which are indicated by reference numerals 52*a*–52*d*. The drive members 52*a*–52*d* can be raised into operative position, for driving engagement with the projections 48 and 50 or retracted downwardly, into inoperative position for disengaging the projections 48, 50, as described in greater detail below. The table tops 44 and the table sub-structures 46*a*–46*f* are supported by sliding contact of the table tops with track 56 (FIG. 6), which extend along opposite sides of the path of travel of the table tops 44 and are in turn supported on the machine frame 12.

Referring again to FIG. 5, the drive connector 36 forms part of a table transfer mechanism indicated generally by reference numeral 55, which includes two table transfer devices carried by the drive connector 36 and indicated, respectively, by reference numerals 58*a*, 58*b*. These table transfer devices 58*a*, 58*b* form pivotable supports and are disposed at right angles to one another.

To facilitate understanding of the manner in which the table sub-structures 46*a*–46*f* are engaged and advanced, chain-dot lines have been employed in FIG. 5 to illustrate the relationship between the drive members 52*a*–52*d* and the leading and trailing projections 48,50 of the table sub-structures 46*a*–46*f*.

The table transfer device 58*a*, as shown in FIG. 5, is in a first position in which it can engage the leading projections 48 of the table sub-structure 46*c* located at an output end 59 of the rails 20*b*. From this first position, the table transfer device 58*a*, carrying with it the table sub-structure 46*c*, is moved, on pivotation of the drive connector 36 through 90° about its pivot shaft 40, into an intermediate position, in which the table transfer device 58*b* is shown in FIG. 5. At the same time, the table transfer device 58*b* is pivoted through 90 degrees from the intermediate position, in which it is shown in FIG. 5, to a third position at an input end 61 of the rails 20*a*, above which the table sub-structure 46*e* is shown in FIG. 5.

More particularly, the drive members 52*a* and 52*b* are spaced apart along their carriages 22*a*, 22*b* so that the drive members 52*a* engage the leading projections 48 of the table substructure 46*a* and the drive members 52*b* engage the trailing projections 50 of the table substructure 46*b*. As the drive connector 36 is pivoted from the position in which it is shown in FIG. 5, through 90 degrees, the table sub-structure 46*b* will be advanced through a distance equal to the distance from one to the next of the printing stations, by driving engagement of the drive members 52*b* with the trailing projections 50 of the table substructure 46*b*, into the position in which the table sub-structure 46*c* is shown in FIG. 5. In this position, the drive members 52*b* are retracted downwardly out of engagement with the trailing projections 50 of the table sub-structure 46*b*, and drive members 60 on the table transfer device 58*a* are extended upwardly into engagement with the leading projections 48 of the table sub-structure. When the drive connector 36 is then pivoted through 90 degrees from the position in which it is shown in FIG. 5, the table transfer device 58*a* drives the table sub-structure from the first position to the intermediate position, and the drive members 60 are then retracted downwardly to release the table sub-structure in the intermediate position.

Prior to this pivotation of the drive connector 36, drive members 62 on the table transfer device 58*b* are extended upwardly into engagement with the trailing projections 50 of the table sub-structure in this intermediate position. Consequently, when the drive connector 36 pivots from its position shown in FIG. 5, this table sub-structure is advanced from the intermediate position to the third position, at the input end 61 of the rails 20*a*.

As this occurs, the preceding table sub-structure is moved along the rails 20*a* from the third position by the drive members 52*c* in engagement with the trailing projections 50 of that table sub-structure and, simultaneously, the drive members 52*d*, which have been raised into engagement with the trailing projections 50 of the table sub-structure 46*f*, displace the latter along the rails 20*a*.

Figure 6:
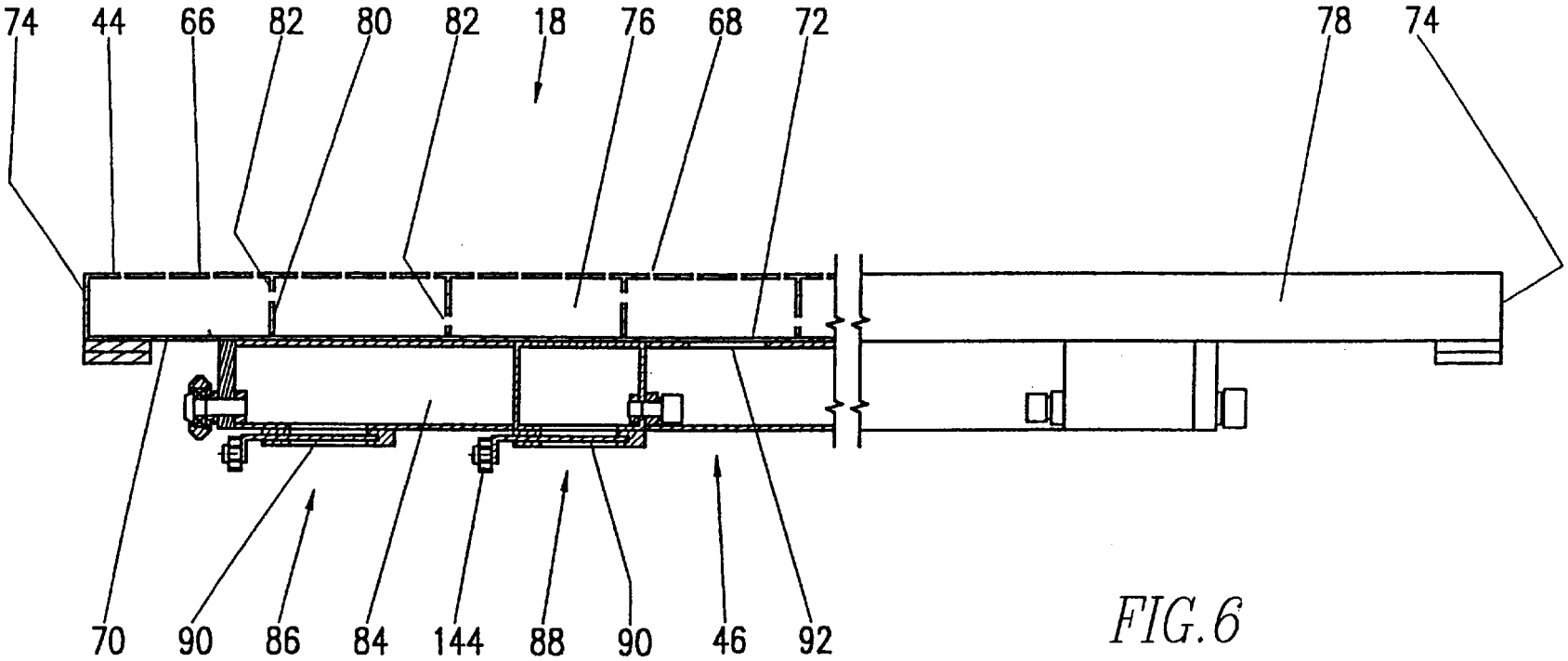
FIG. 6 shows a view, partly in cross-section, through an article support used in the machine of FIG. 1 through 5.

FIG. 6 shows in greater detail the construction of one of the vacuum tables, which is indicated generally by reference numeral 18, and it is to be understood that the vacuum table 18 is similar in construction to vacuum tables 18*a*–18*e* and that, in practice, the machine 10 is normally provided with twelve vacuum tables as indicated above, and that they are all similar to one another.

As shown in FIG. 6, the vacuum table 18 includes one of the table tops 44, which has a hollow interior defined by a top 66, formed with perforations 68, a bottom 70, formed with an opening 72, opposite side walls 74, an end wall 76 and an opposite end wall 78. For reinforcement, the interior of the table top 44 is provided with an internal honeycomb structure formed by partitions 80, and the partitions 80 are formed with openings 82.

The table sub-structure, which in this Figure is indicated generally by reference numeral 46 and which is similar to the table sub-structures 46*a*–46*f* of FIG. 5, has a hollow interior 84 and vacuum ports indicated generally by reference numerals 86 and 88, which are normally closed by slidable closure members 90.

The vacuum ports 86 are stationary and the vacuum ports 88 are mounted on the carriages 22*a* and 22*b* for reciprocation therewith. When one of these vacuum ports 86 and 88 is opened and a vacuum is applied to the opened port, as described below, the vacuum is communicated through the hollow interior 84 of the table sub-structure 46, through an opening 92 in the top of the latter and through an opening 72 in the bottom 70 of the table top 44 to the perforations 68. In this way, an article of flat stock which is to be printed is held firmly by vacuum on the top of the table top 44.

The end sections 14 are provided with stationary vacuum ports 87 and movable vacuum ports 89 are mounted on the drive connectors 36 for to-and-fro pivotation therewith.

Figure 7:
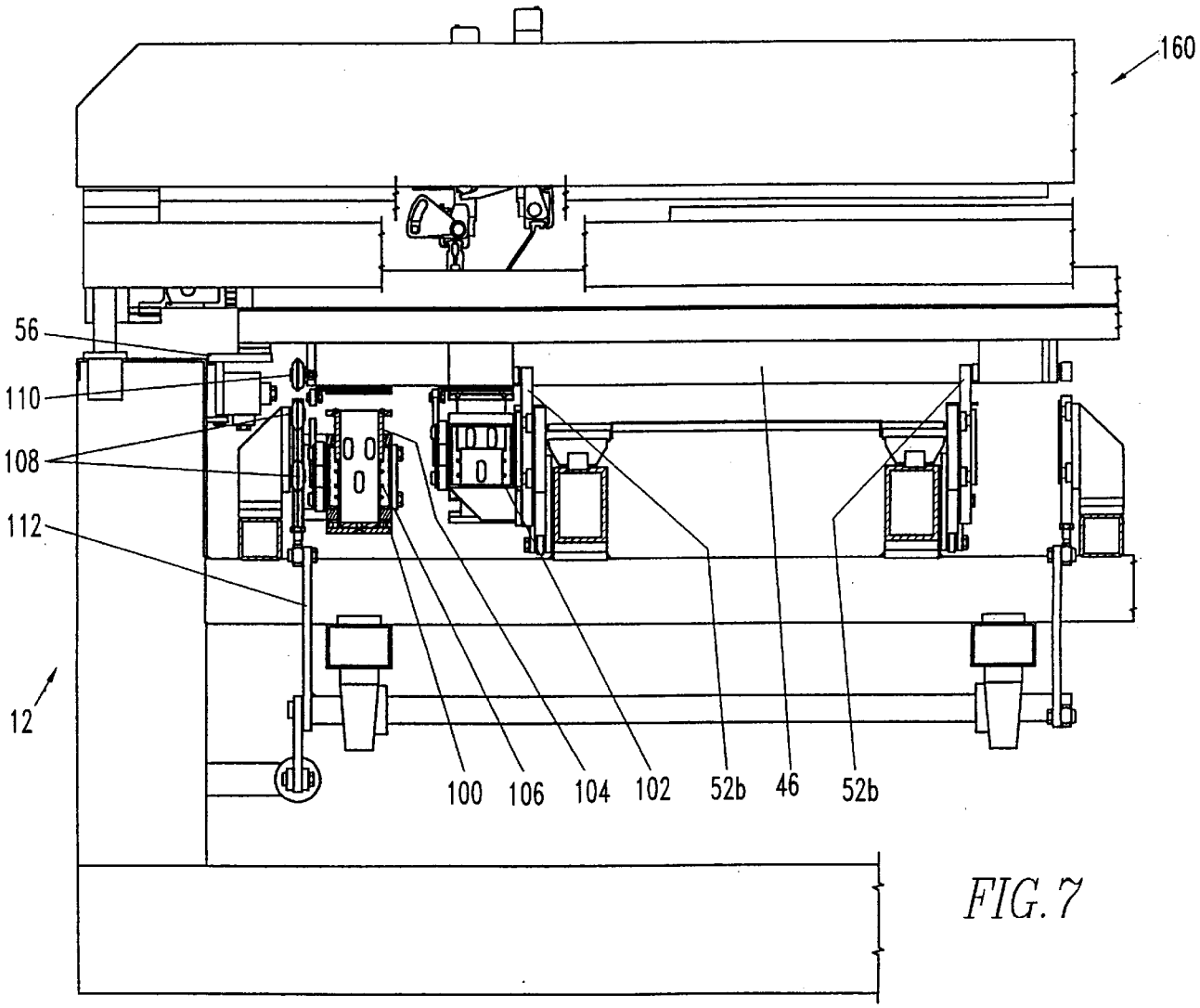
FIG. 7 shows a broken-away view taken partly in cross-section through a printing station of the machine of FIGS. 1 through 5.

Referring again to FIG. 1, it will be seen that the machine 10 includes a stationary vacuum duct 96 extending along each pair of rails 20*a*, 20*b* and also a movable vacuum duct 98, which is secured to the respective carriage 22*a*, 22*b*. The vacuum ducts 96 and 98 are provided with vacuum connectors 100 and 102, one each of which is shown in FIG. 7.

The vacuum connector 100 has an open-top tube 104 which can be lowered into an inoperative position against the action of a compression spring 106 and raised, into engagement with an overlying one of the vacuum ports 86 for applying a vacuum from the vacuum duct 96 to the overlying table sub-structure 46.

Figure 14:
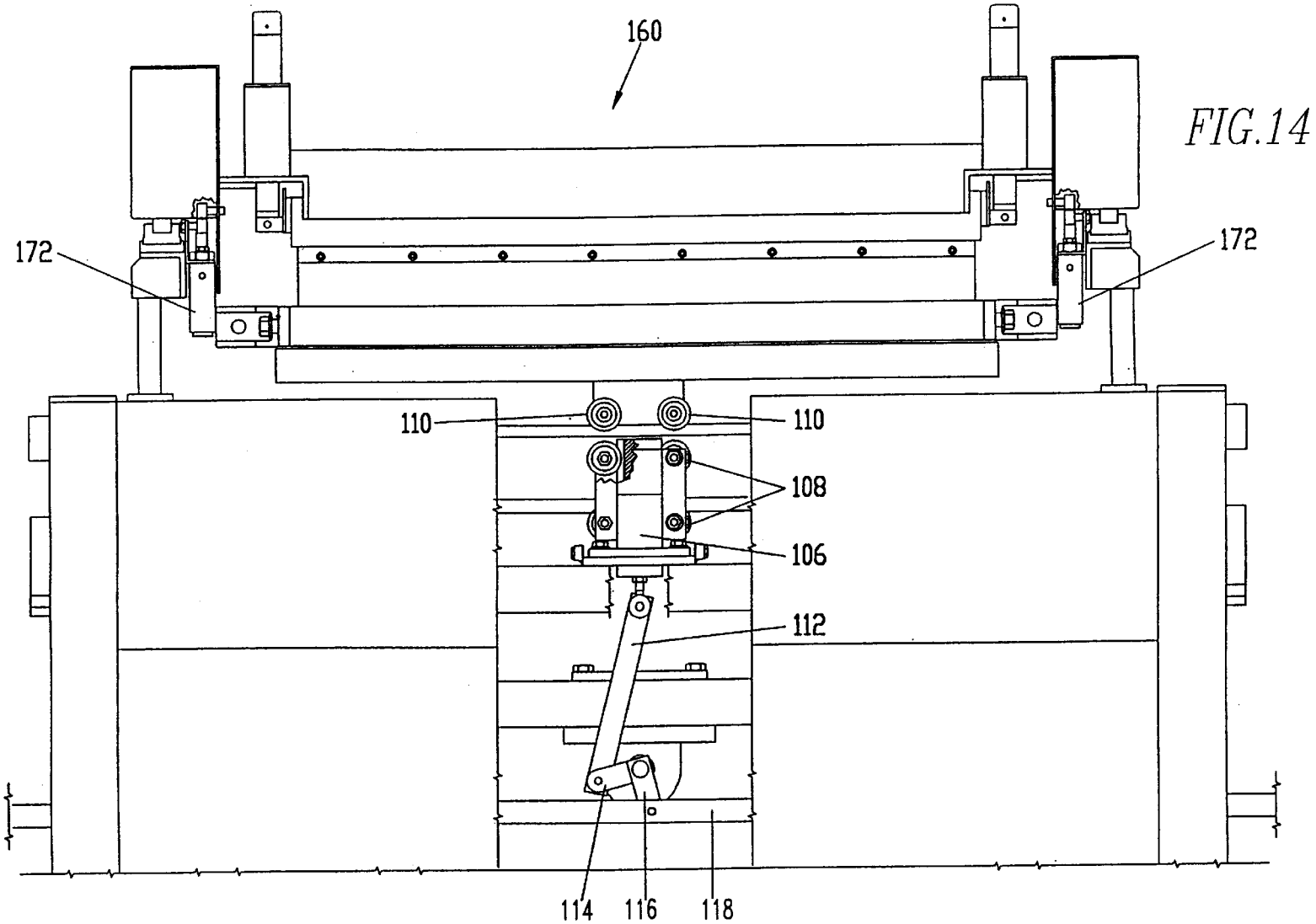
FIG. 14 shows a broken-away view, in side elevation, of one of the printing stations of the machine of FIGS. 1 through 13.

The tube 104 is secured for movement with a vertically elongate, vertically displaceable alignment member 106 (FIG. 14), which is guided by means of rollers 108 mounted on the machine frame and which, when raised, engages between rollers 110 on the table substructure 46 for locating the latter in position at the printing station for correct alignment during printing. The vertical displacement of the alignment member 106 and, therewith, the tube 104 is effected by means of a lever linkage comprising levers 112, 114 and 116 connected to a rod 118, which is horizontally reciprocatable, by means of a pneumatic piston and cylinder 120 (FIG. 8) connected to the machine frame.

Figure 12:
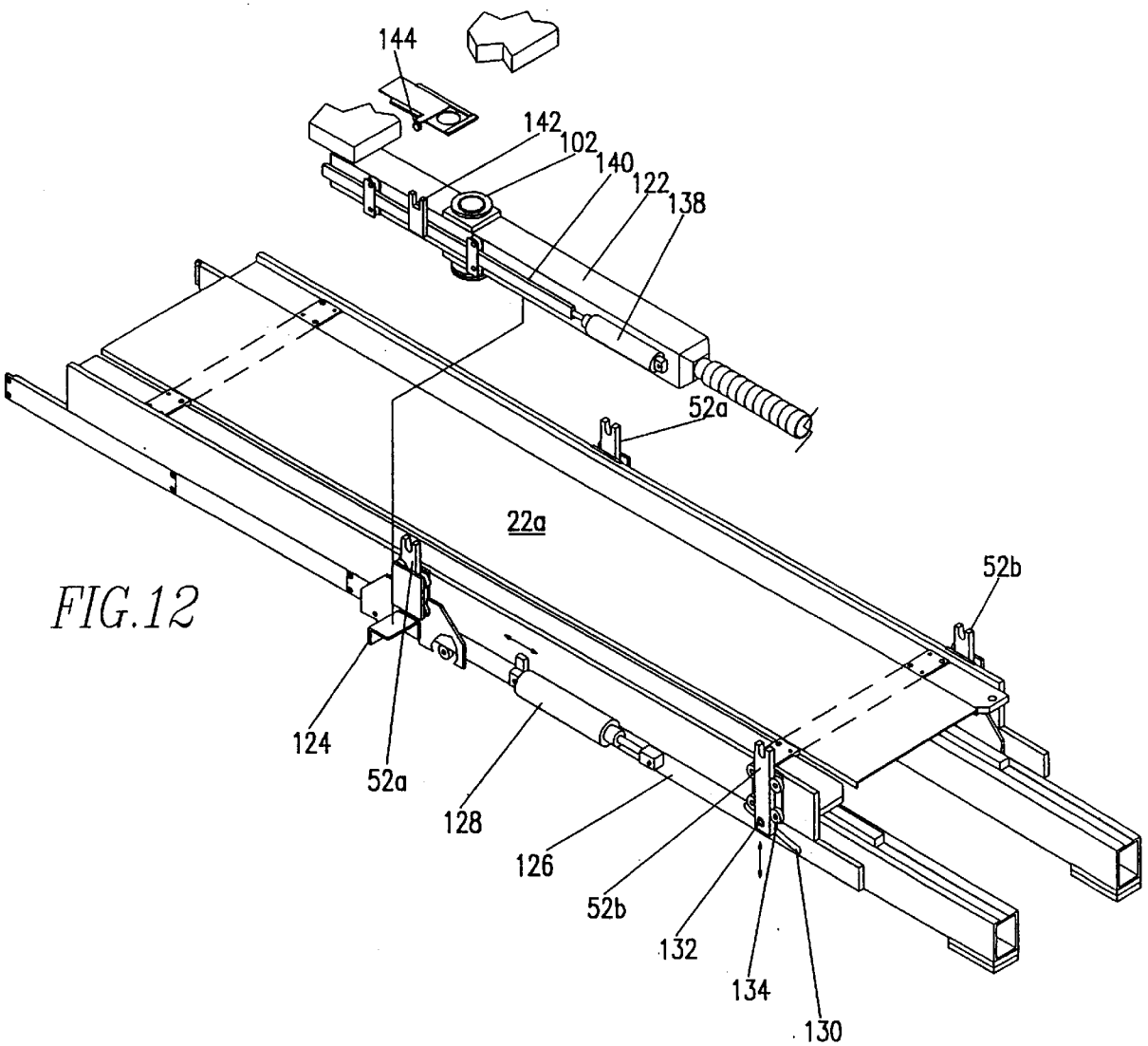
FIG. 12 shows a partly-exploded, broken-away view in perspective of parts of a carriage and a vacuum ducting system of the machine of FIGS. 1 through 11.

As shown in FIG. 12, the vacuum connector 102 is provided in a duct section 122, which is mounted on a support bracket 124 carried by the carriage 22*a*. A similar arrangement is mounted on the carriage 22*b*. The bracket 124 is mounted on the drive member 52*a*. A bar 126 can be displaced to and fro, in a horizontal direction, relative to the carriage 22*a* by means of a pneumatic piston-and-cylinder device 128. The bar 126 is provided with inclined slots, of which only one is shown and is indicated by reference numeral 130, into which engage pins 132 on the drive members 52*a* and 52*b*, which are mounted in guide rollers 134 so as to be vertically movable, to and fro, relative to the carriage 22*a* into and out of driving engagement with the projections 48 and 50 in accordance with the displacement of the bar 126 relative to the carriage 22*a*. The bracket 124 is secured to one of the drive members 52*a* for vertical movement therewith, and this vertical movement serves to move the vacuum connector 102 into and out of engagement with the vacuum port 88. During this vertical upward movement of the vacuum connector 102, a pneumatic piston-and-cylinder device 138 on the vacuum duct section 122 is employed to effect horizontal displacement of a bar 140, carrying a drive member 142, which engages a roller 144 on the closure member 90 of the port 88 in order to open this port 88.

Figure 8:
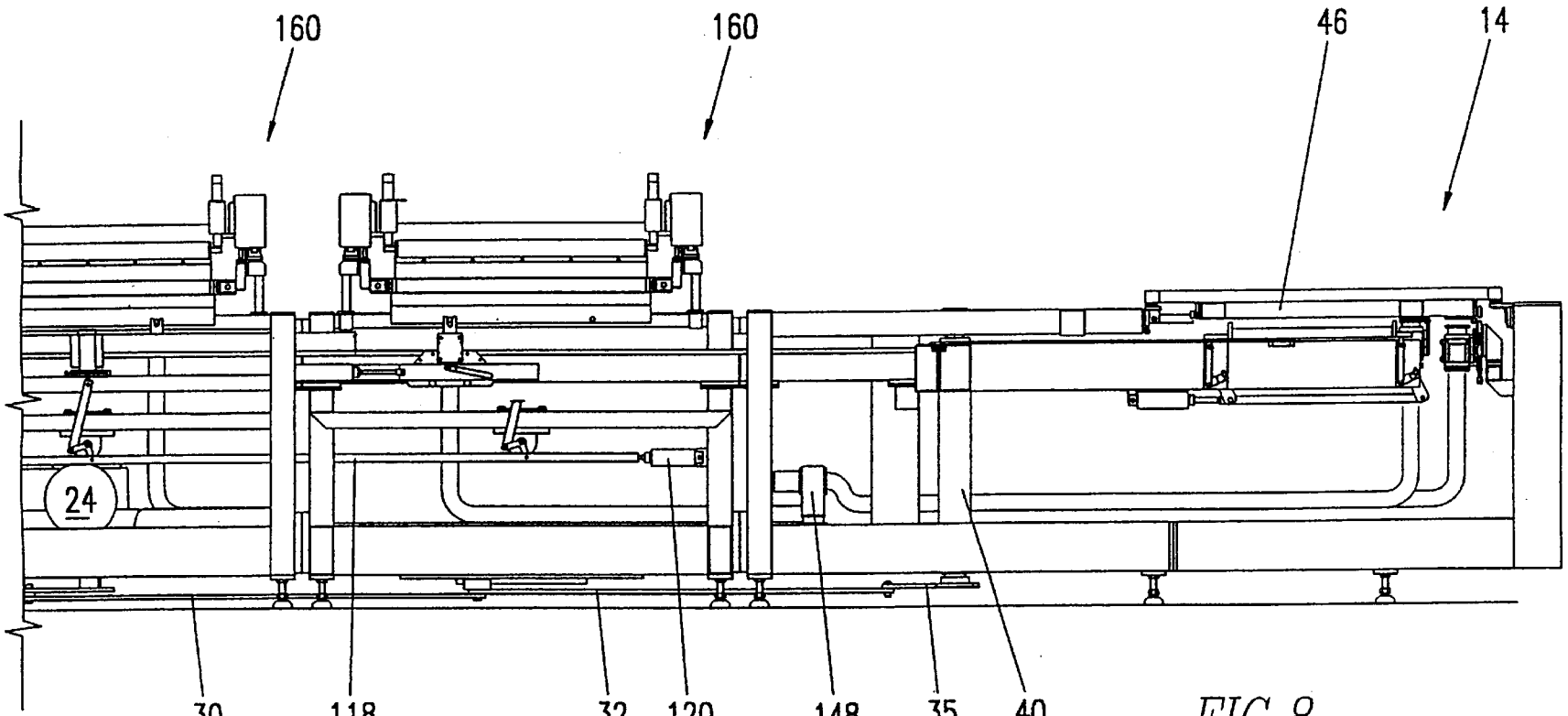
FIGS. 8 and 9 show broken-away views, in side elevation, of respective halves of the screen printing machine of FIG. 1.
Figure 9:
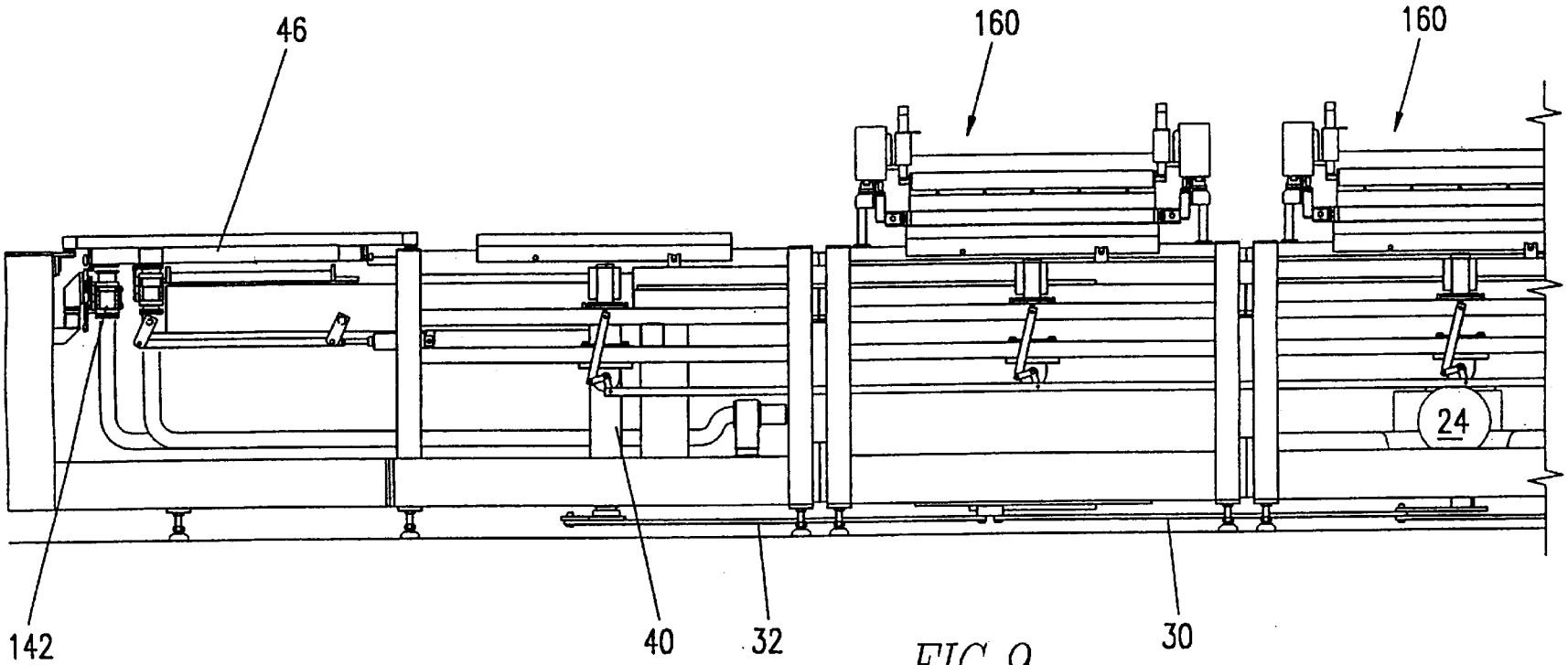
Figure 10:
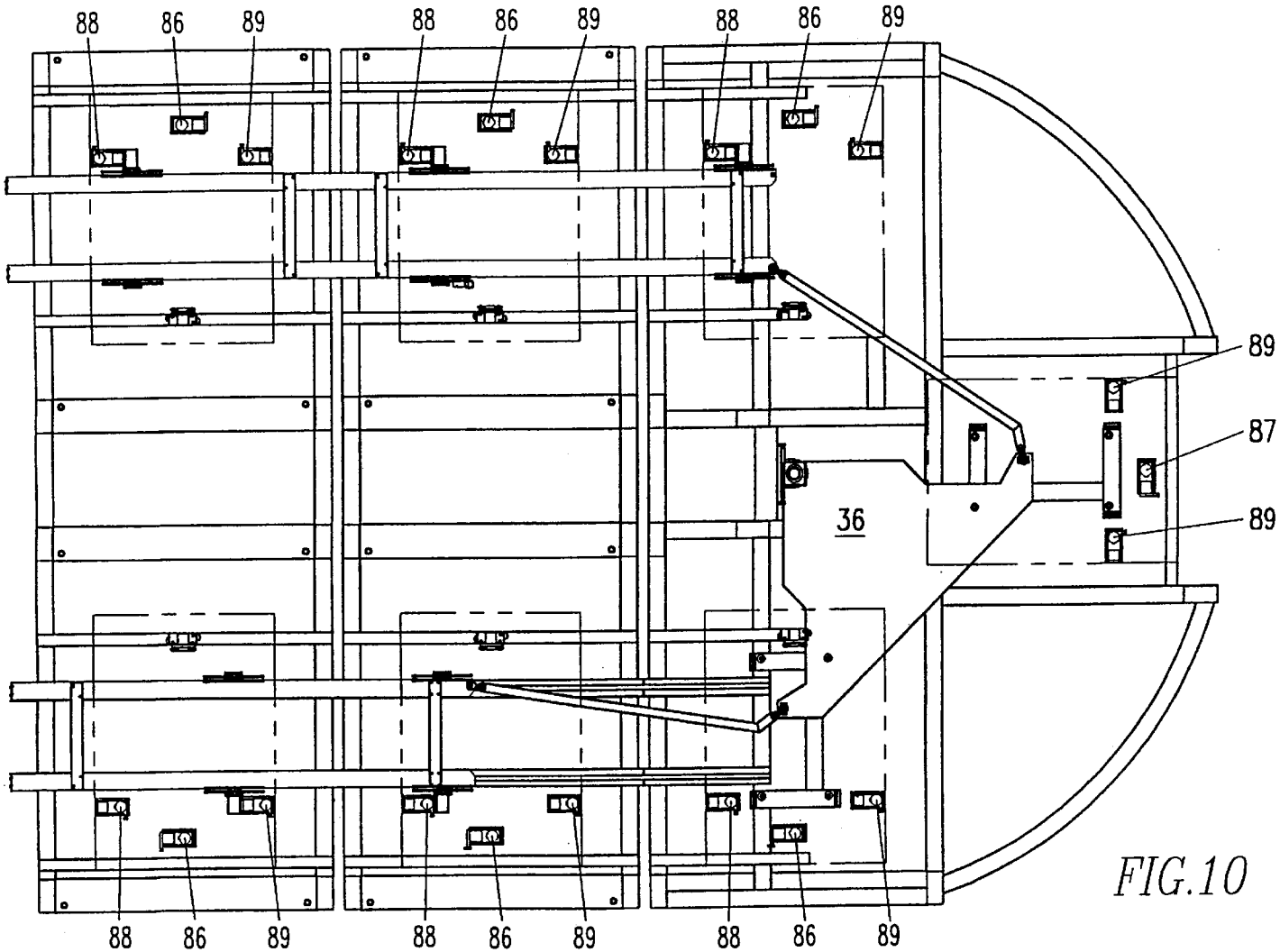
FIG. 10 shows a broken-away plan view of parts of the screen printing machine of FIG. 1.

Each of the table sub-structures 46, as shown in FIG. 10, is provided with two of the vacuum connectors 102, so that one of these vacuum connectors can be connected to the vacuum duct 98 during movement of the table sub-structure to the transfer mechanism 55, while the other port 105 is then available for connection 142 for use during the transfer of this table sub-structure 46 from the first position to the intermediate position, as described above. The vacuum ducts 96 and 98 are connected to a vacuum pump 148 (FIG. 8).

Figure 11:
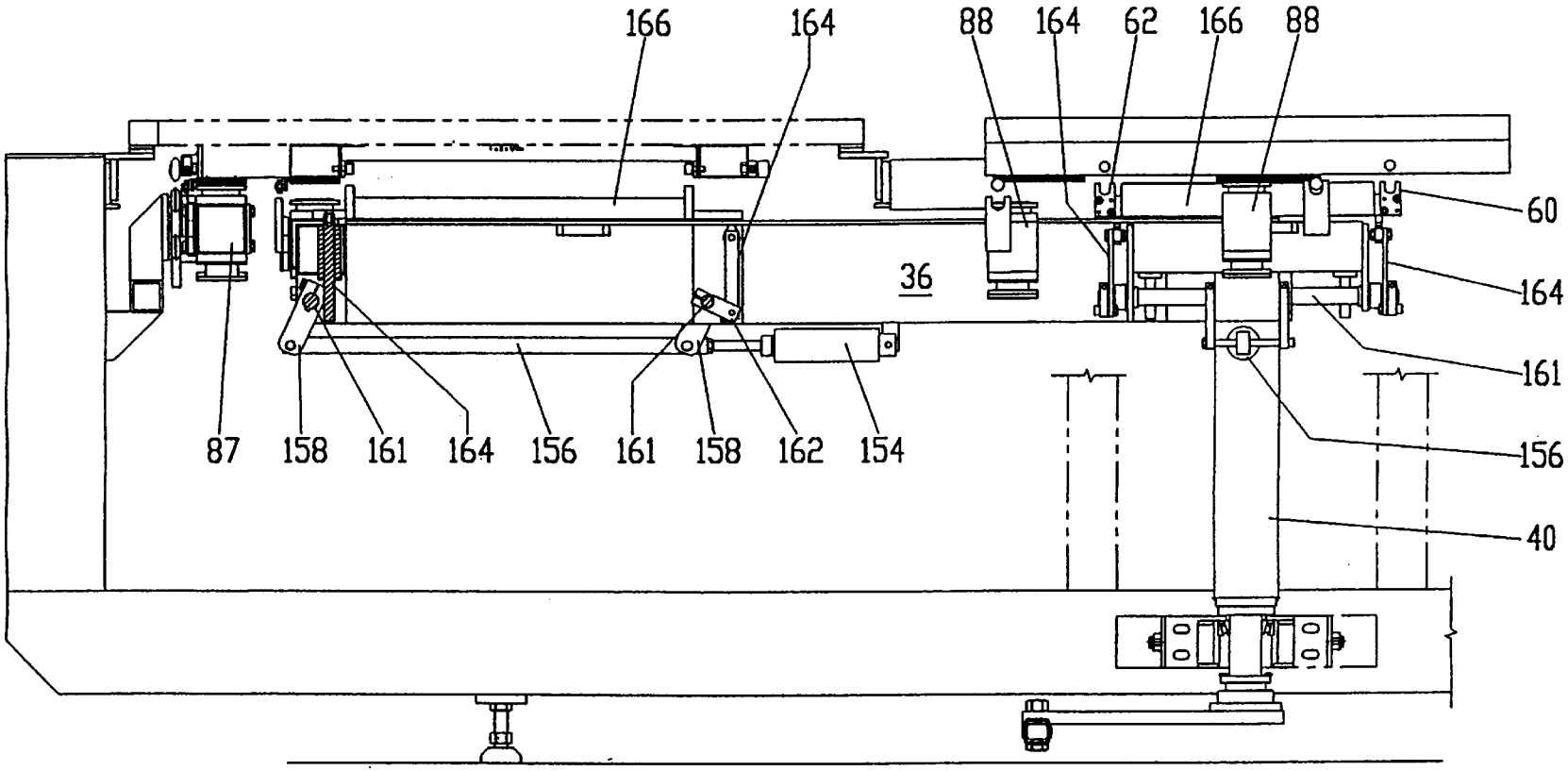
FIG. 11 shows a broken-away side view, partly in vertical cross-section of a table transfer device forming part of the machine of FIGS. 1 through 10.

FIG. 11 shows the mechanisms for raising and lowering the drive members 60 and 62 into and out of engagement with the leading and trailing projections 48 and 50 of the table sub-structures 46 at the transfer mechanisms 55.

For this purpose, a pneumatic piston-and-cylinder device 154 at the underside of the respective drive connector 36 is provided for reciprocating a rod 156 and, thereby, through levers 158, shafts 161, and levers 162 and 164 correspondingly raising and lowering support frames 166, on which the drive members 60 and 62 are mounted.

At each printing station there is provided a printing head indicated generally by reference numeral 160, which bridges the path of travel of the vacuum tables 18, and which is provided with a squeegee and squeegee holder and the flat bar and flat bar holder which are similar to those described in my above-mentioned co-pending U.S. patent application Ser. No. 08/939,407, and which, therefore, are not described in greater detail herein.

Figure 13:
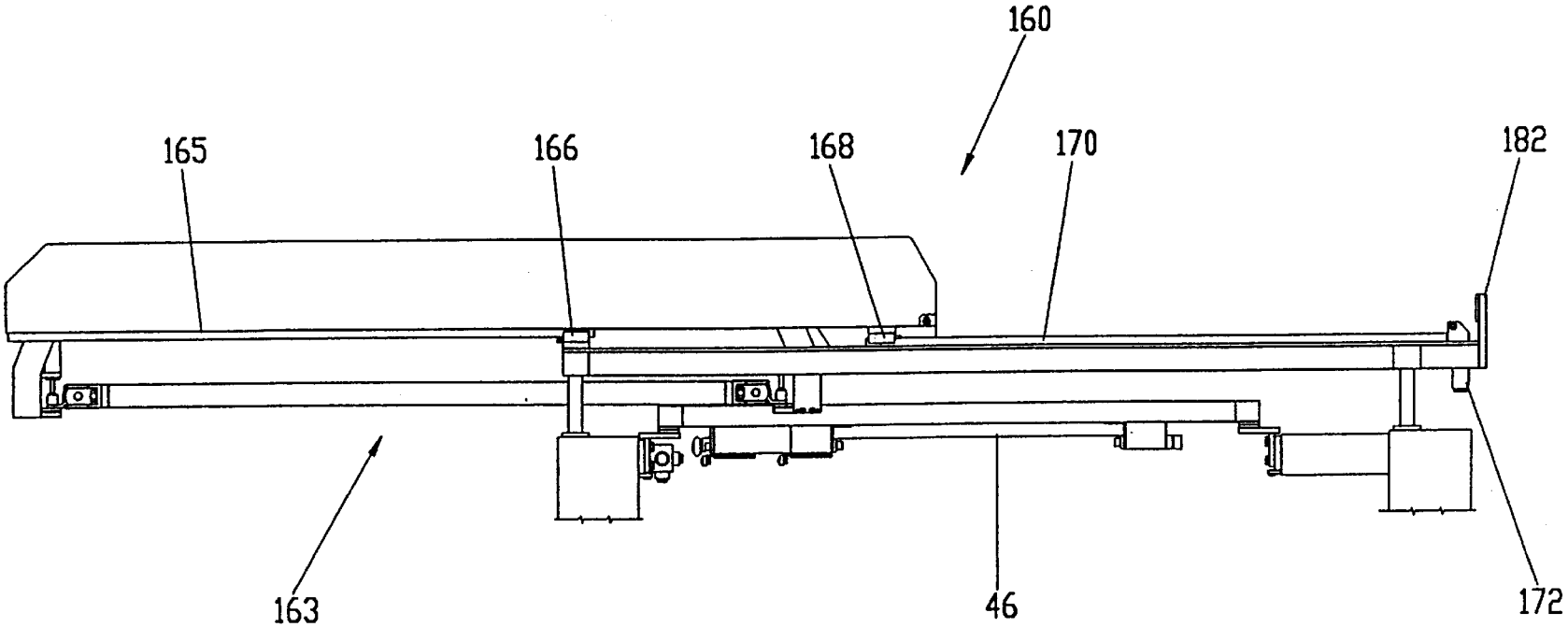
FIG. 13 shows a view in side elevation of parts of a printing station in the machine of FIGS. 1 through 12 in an inoperative condition.
Figure 15:
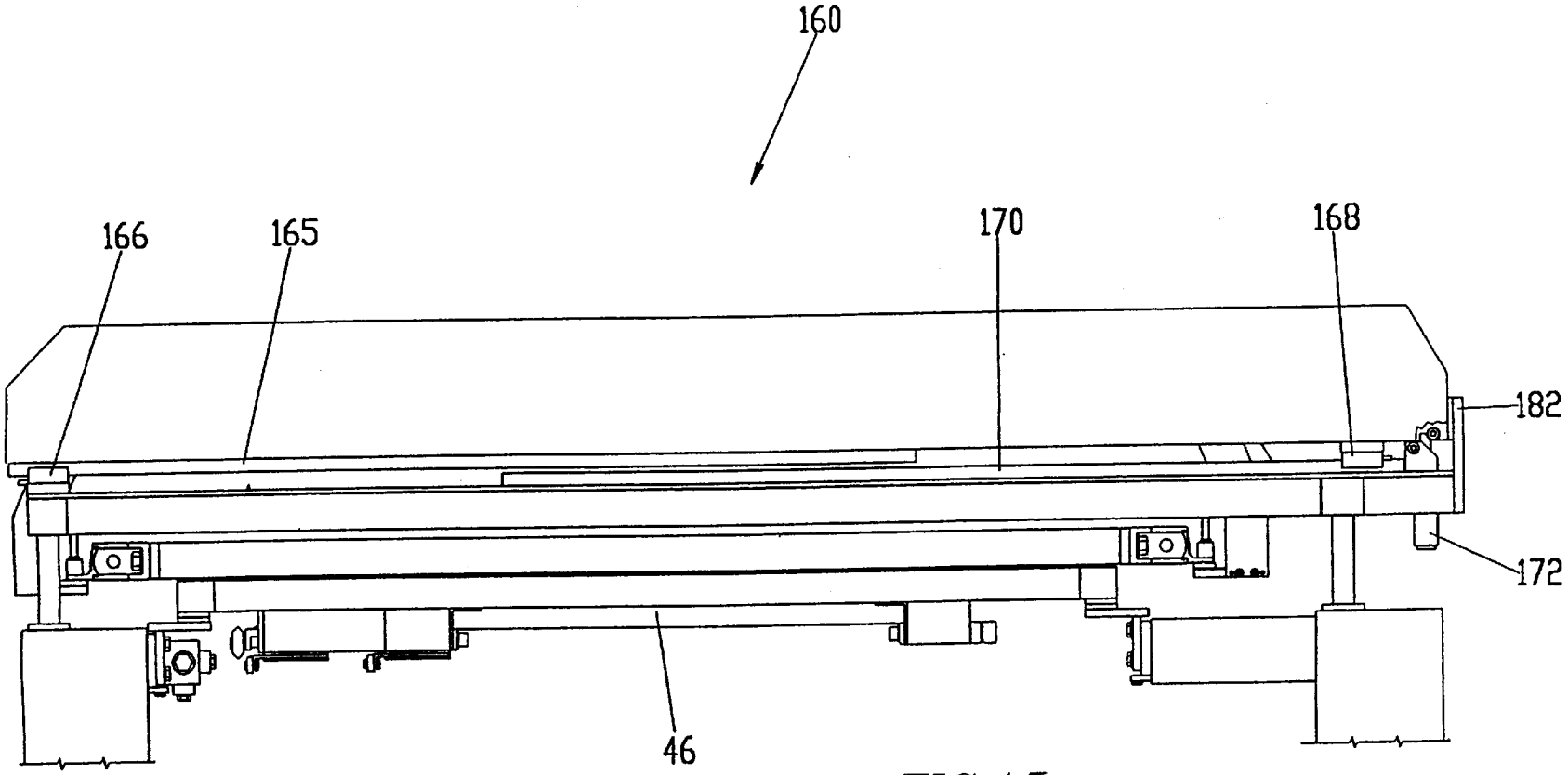
FIG. 15 shows a view corresponding to FIG. 13 but with the printing station in an operative condition.

In the present machine, however, each printing head 160 is horizontally displaceable into an inoperative position, in which the printing head 160 is shown in FIG. 13, from an operative position, in which the printing head 160 is shown in FIG. 15, in order, thus, to provide ready access to a printing screen carried by the printing head and indicated generally by reference numeral 163 in FIG. 13, for the purpose of maintaining or replacing the printing screen 163. For that purpose, rails 165 (FIG. 13) at the underside of the printing head 160 are slidable in guides 166 mounted on the machine frame, and guides 168 on the printing head are slidably engaged with rails 170 mounted on the machine frame.

Figure 16:
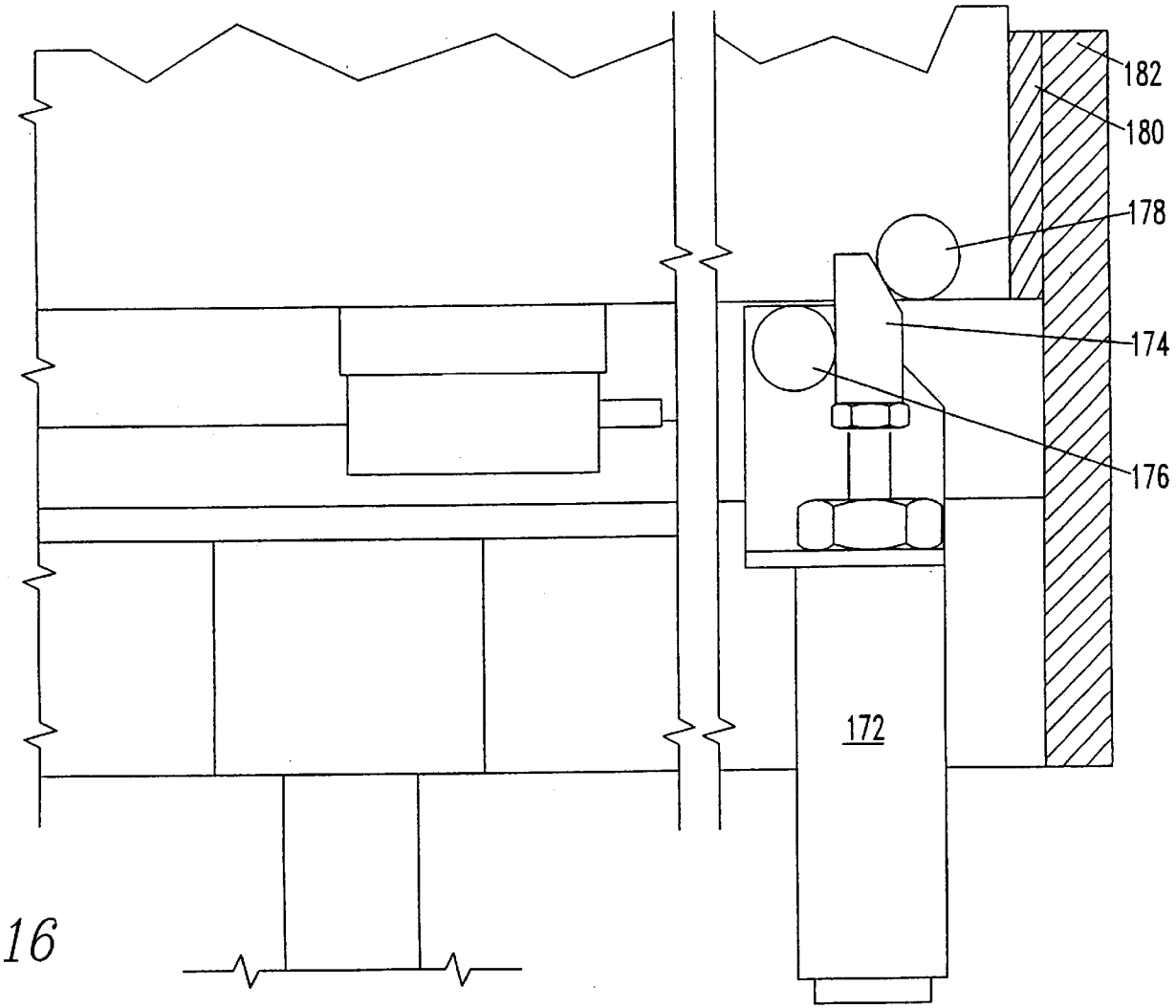
FIG. 16 shows a broken-away view, partly in vertical cross-section, through a locking mechanism forming part of the printing station of FIGS. 13 through 15.

For locking the printing head 160 in its operative position, as shown in FIG. 15, a pair of locking cylinders 172 (FIG. 14) are operable to raise and lower a locking cam 174 (FIG. 16) which, in its raised position, as shown in FIG. 16, engages between rollers 176 and 178 which are mounted, respectively, on the machine frame 12 and on the printing head 160. By engagement with the roller 178, the locking member 174 urges the printing head 160 into firm abutment with a nylon pad 180 on a wall 182 on the machine frame 12, thus ensuring that the printing head 160 is securely and accurately locked in position.

FIGS. 17 through 21 illustrate a modified vacuum ducting arrangement for supplying vacuum to the vacuum tables 18 as the vacuum tables 18 are displaced around their endless path of travel.

Figure 17:
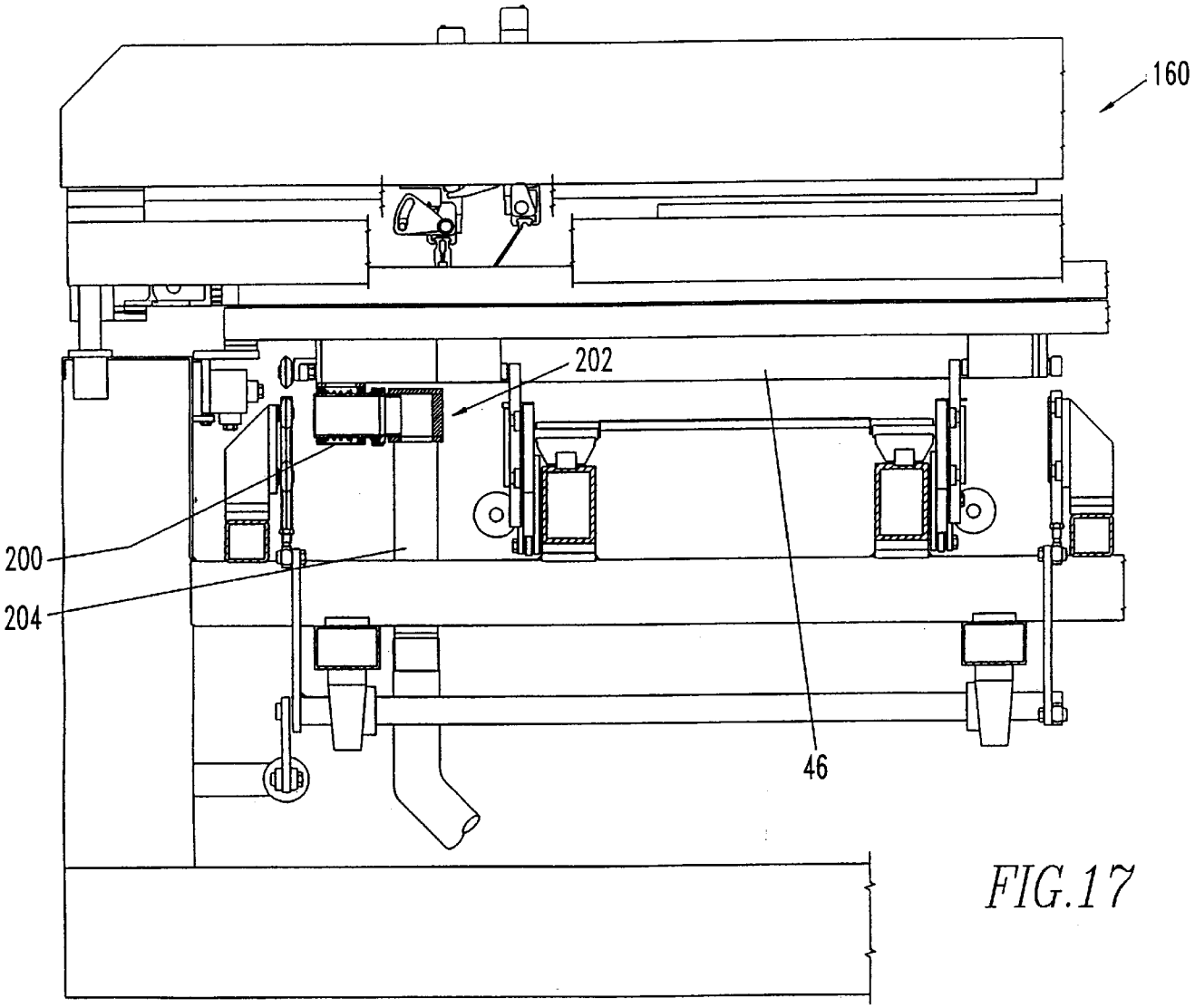
FIG. 17 shows a broken-away view, in vertical cross-section, corresponding to FIG. 7, but showing a modified vacuum ducting system.
Figure 18:
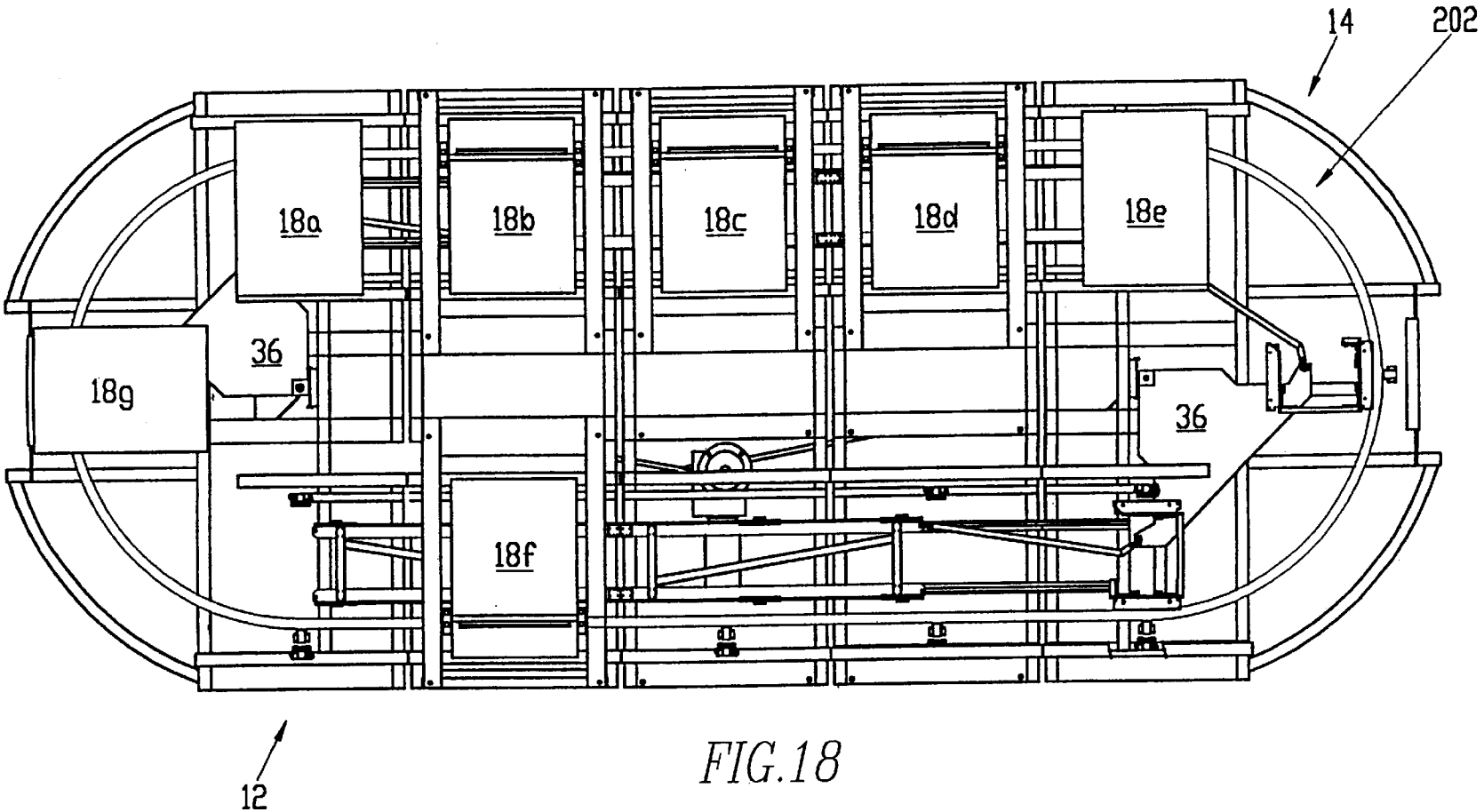
FIG. 18 shows a plan view of the machine, corresponding to FIG. 1, but showing parts of the modified ducting system of FIG. 17.

Referring firstly to FIG. 17, reference numeral 200 indicates generally a vacuum port at the underside of one of the vacuum table sub-structures 46, this vacuum port 200 being urged resiliently in a horizontal direction, as described in greater detail below, towards an endless, horizontally extending vacuum duct, indicated generally by reference numeral 202, which, as will be more readily apparent from FIG. 18, extends around the endless path of travel of the vacuum tables 18. The vacuum duct 202 is connected by a duct 204 to the vacuum pump 148.

Figure 19:
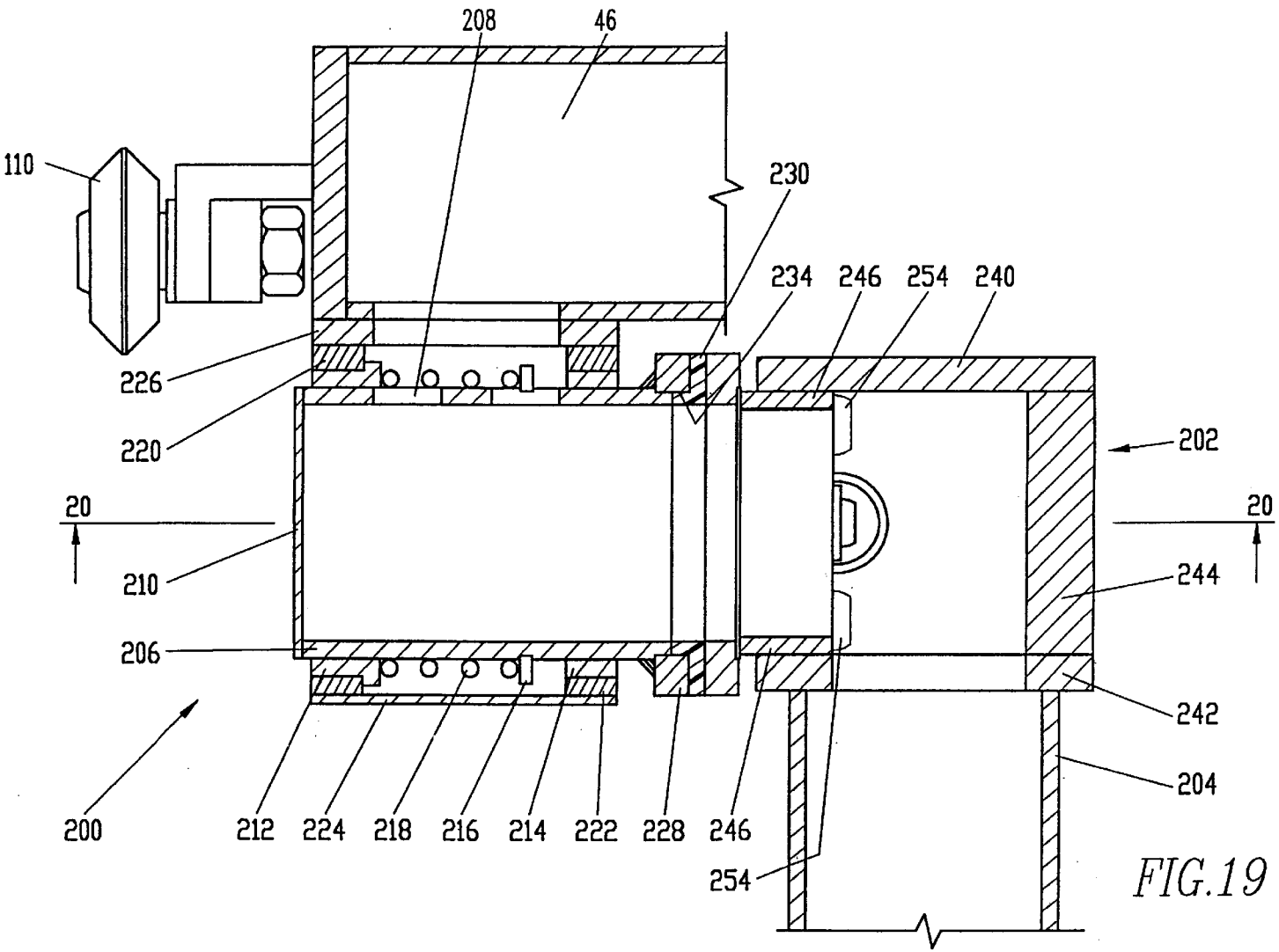
FIG. 19 shows a view taken in vertical cross-section through parts of the modified vacuum ducting system of FIG. 17.
Figure 20:
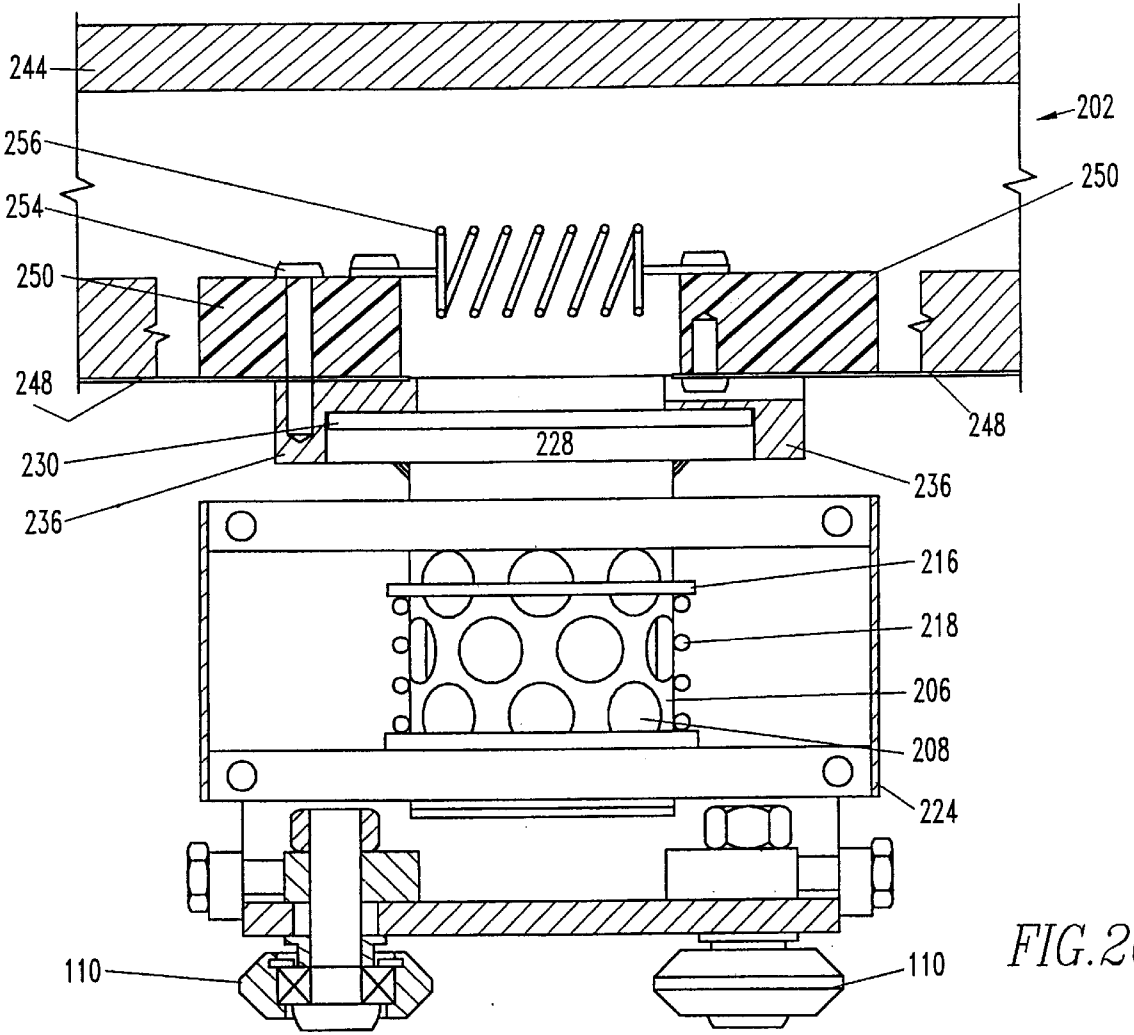
FIG. 20 shows a view taken in cross-section along the line 20—20 of FIG. 19.
Figure 21:
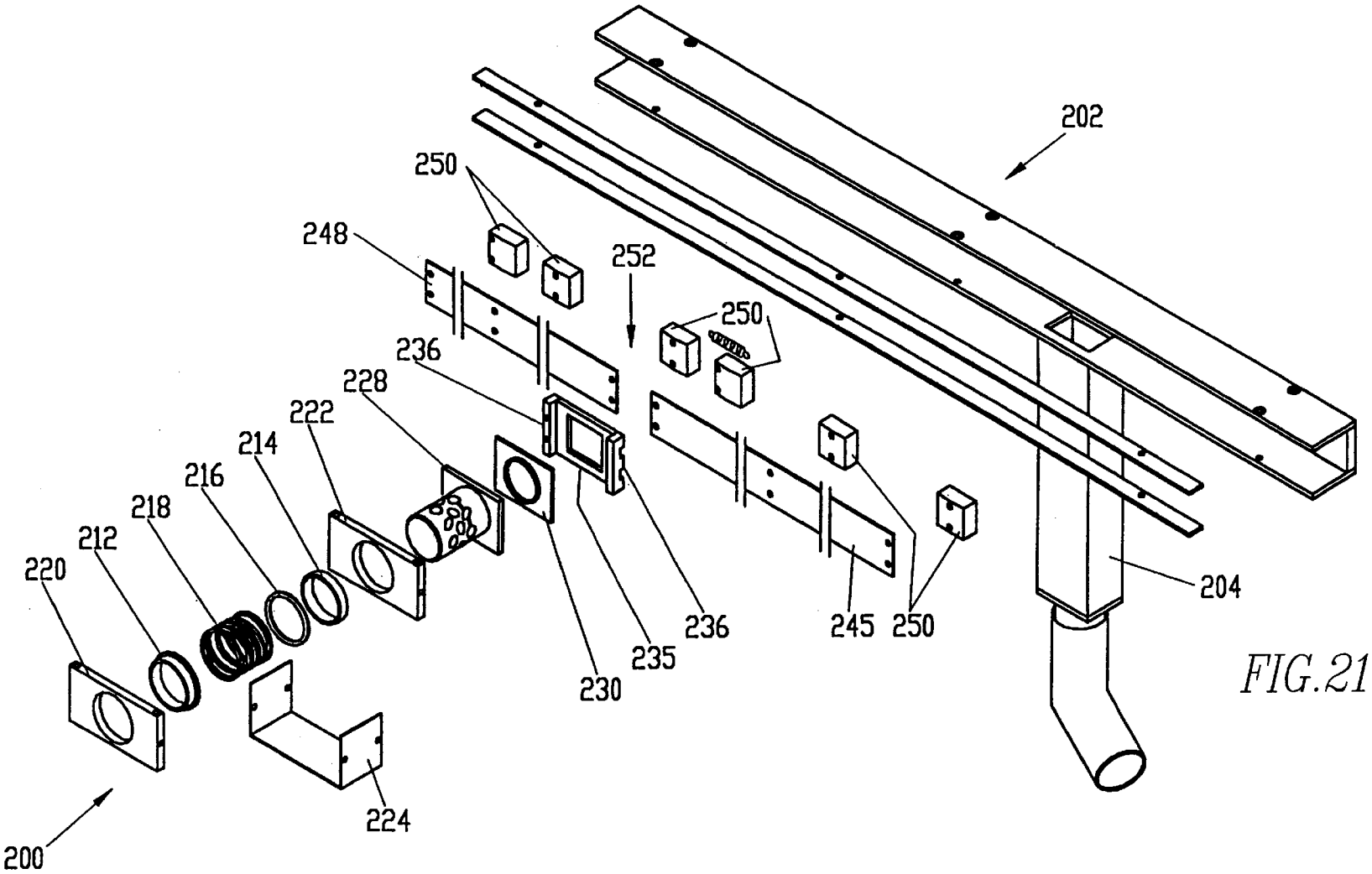
FIG. 21 shows an exploded view in perspective, of parts of the vacuum ducting system of FIGS. 17 through 20.

As shown in FIGS. 19 through 21, the vacuum port 200 comprises a horizontal cylinder 206 which, at its upper side, is formed with openings 208, the cylinder 206 being closed at one end by a circular plate 210. The cylinder 206 is slidably supported, for horizontal sliding movement, in a bronze bushing 212 and a bronze sleeve 214. A retaining ring 216, which is sprung into engagement with the exterior of the cylinder 206, forms an abutment for one end of a helical compression spring 218, the opposite end of which abuts the bushing 212, so that the cylinder 206 is thereby resiliently biased to the right as viewed in FIG. 19. The bushing 212 and the sleeve 214 are fitted into circular openings in rectangular plates 220 and 222 which, together with a housing member 224 (FIG. 21) and an apertured plate 226 at the underside of the table support, form a housing from which opposite ends of the cylinder 206 extend.

The end of the cylinder 206 remote from the end wall plate 210 is welded to a rectangular plate 228, and a cushion plate 230 of plastic material sold under the trade mark DELRIN is fitted onto the plate 228. More particularly, the cushion plate 230 has a circular opening formed with a flange 232, which mates with a circular opening 234 in the plate 228 and abuts the cylinder 206.

The cushion plate 230 is urged, by the compression spring 218, into sliding contact with a generally rectangular component in the form of an apertured rectangular frame 235 which has, at opposite lateral sides thereof, parallel vertical elongate projections 236, between which the cushion plate 230 is received, as apparent from FIG. 20. Consequently, as the table is displaced around the endless path of travel, as described above, the cushion plate 230 and the plate 228, in driving engagement with one of these projections 236, drives the frame 235 around the duct 202. The cushion plate 230 is, however, vertically slidable relative to the frame 235 to allow corresponding vertical movement of the vacuum table 18 at opposite ends of the straight elongate path sections, to allow the vacuum table to be transferred between the carriages 22*a* and 22*b*, as described above.

The vacuum duct 202 is formed by a pair of vertically spaced, horizontal plates 240, 242, and a vertical rear wall 244, which thus form a duct which is open at one horizontal side. This open side forms a horizontally elongate opening extending along the vacuum duct 202 and defined by brass strips 246 secured, respectively, to the top and bottom plates 240 and 242 of the duct 202 and projecting laterally from the top and bottom plates 240 and 242, as shown in FIG. 19.

This opening is partially closed by a closure which comprises a plurality of strip metal sections 248, and blocks 250, of DELRIN, which are secured to the strip metal sections 248 and which are engaged between and in sliding contact with the brass strips 246.

Successive strips 248 are separated from one another by gaps, one of which is indicated generally by reference numeral 252 in FIG. 21.

At one side of each gap 252, an end of one of the strip metal sections 248 and one of the blocks 250 are secured to one side of the frame 235 by a pair of screws, of which only one is shown and is indicated by reference numeral 254. However, the opposite side of the frame 235 is not connected to the adjacent end of the next section 248, so that the latter is slidable relative to the frame 235. The ends of the strips 248 at opposite sides of the gap 252 are resiliently connected to one another by means of a helical tension spring 256, as shown in FIG. 20, the spring 256 being one of a plurality of tension springs connecting the strips 248 in this way. The strip metal sections 248 are thus connected to one another to form an endless closure in the form of a belt which travels with the vacuum tables 18 and, by means of these helical compression springs, is tensioned into contact with the vacuum duct 202 so that, even when vacuum within the vacuum duct 202 is interrupted, the closure will be held against the vacuum duct 202 and, more particularly, will be held against the brass strips 246.

I claim:

1. A screen printing machine, comprising:

a plurality of article supports for articles to be printed;

a displacement mechanism for displacing said article supports in succession around an endless path of travel; and a plurality of printing stations distributed along said path of travel and each having a printing head;

said displacement mechanism comprising drive members engageable with said article supports for displacing said article supports, a reciprocating drive operable to reciprocate said drive members to and fro along said endless path to advance said articles in succession to said printing stations, and actuating devices for displacing said drive members into and out of engagement with said article supports; and said endless path including a pair of parallel elongate straight path sections, tracks extending along said straight path sections and a pair of carriages carried on said tracks, said drive members being mounted on said tracks and said reciprocating drive being connected to said carriages for displacing said carriages to and fro, in opposite directions to one another, along said tracks.

2. A printing machine as claimed in claim 1, wherein said reciprocating drive comprises a prime mover, connecting rods and pivot connections interconnecting said connecting rods, said connecting rods and said pivot connections forming a drive connection between said prime mover and said carriages.

3. A screen printing machine as claimed in claim 1, which includes, at opposite ends of said elongate path sections, horizontally pivotable drive connectors, said screen printing machine further comprising pivots permitting pivotation of said drive connectors to and fro about respective vertical axes, links extending between said drive connectors and said carriages and pivot connections connecting said links to said carriages and to said drive connectors.

4. A screen printing machine as claimed in claim 3, wherein said drive comprises a drive motor, a gearing connected to said drive motor, a crank arm extending from said gearing and connecting rods connecting said crank arm to said drive connectors.

5. A screen printing machine as claimed in claim 3, including further drive members mounted on said drive connectors for transferring said article supports in succession between said carriages.

6. A screen printing machine as claimed in claim 5, wherein said article supports each have leading and trailing projections engageable by said drive members, said elongate path sections have input and output ends and said drive members are positioned to engage said trailing projections at said output ends of said elongate path sections, and wherein said further drive members on said drive connectors comprise first drive members engageable with said leading projections between first positions at said output ends of said elongate path sections and intermediate positions between said carriages and second drive members engageable with said trailing projections between said intermediate positions and said input ends of said elongate path sections.

7. A screen printing machine, comprising:

a plurality of vacuum tables for supporting articles to be printed;

a displacement mechanism for displacing said vacuum tables in succession around an endless path of travel;

said endless path of travel including a pair of parallel elongate path sections;

a plurality of printing stations distributed along said elongate path sections and each having a printing head;

said vacuum tables each having a top support surface, a plurality of perforations in said top support surface, a hollow interior space and a vacuum port communicating through said hollow interior space with said perforations;

said displacement mechanism comprising tracks extending along said elongate path sections, elongate reciprocatable carriages mounted on said tracks for longitudinal movement along said tracks, a drive operable to reciprocate said carriages to and fro along said tracks and drive members provided on said carriages and engageable with said vacuum tables for moving said vacuum tables, in accordance with the reciprocation of said carriages, in succession to said printing stations;

a vacuum duct system;

said vacuum duct system comprising vacuum connectors at said printing stations for connecting said vacuum duct system to said vacuum ports of said vacuum tables; and a vacuum pump connected to said vacuum system.

8. A screen printing machine as claimed in claim 7, wherein said drive includes, at opposite ends of said elongate path sections, drive connections to said carriages, said drive connections comprising horizontally pivotable drive connectors, pivots permitting pivotation of said drive connectors to and fro about respective vertical axes, links extending between said drive connectors and at least one of said carriages and pivot connections connecting said links to said carriages and to said drive connectors.

9. A screen printing machine as claimed in claim 8, wherein said elongate path sections have input and output ends, said article supports have leading and trailing projections engageable by said drive members, said drive members are positioned to engage said trailing projections at output ends of said elongate path sections, and said drive connectors have first drive members engageable with said leading projections between first positions at said output ends of said elongate path sections and intermediate positions between said carriages and second drive members engageable with said trailing projections between said intermediate positions and said input ends of said elongate path sections.

10. A screen printing machine as claimed in claim 7, wherein said drive includes drive connections to said carriages, said drive connections comprising horizontally pivotable drive connectors, pivots permitting pivotation of said drive connectors to and fro about respective vertical axes, links extending between said drive connectors and said carriages and pivot connections connecting said links to said carriages and to said drive connectors.

11. A screen printing machine, comprising a plurality of printing stations arranged in succession on an endless path;

a plurality of article supports for carrying articles to be printed;

a reciprocating displacement mechanism for driving said article supports along said endless path of travel;

said reciprocating displacement mechanism comprising a plurality of drive members spaced apart along said path, a drive motor, and a drive linkage between said drive motor and said path members, said drive linkage being operable to reciprocate said drive members to and fro along said path; and said drive members being drivingly engageable with said article supports for moving said article supports along said path and thereby moving said articles in succession to said printing stations.

12. A screen printing machine as claimed in claim 11, wherein said drive members are extendible into operative positions for driving engagement with said article supports and retractable from said operative positions into inoperative positions for disengaging said drive members from said article supports, said displacement mechanism including drive member actuating mechanisms for displacing said drive members to and fro between said operative positions and said inoperative positions.

13. A screen printing machine as claimed in claim 11, including a pair of rails extending along said path and a carriage mounted on said rails, said reciprocating displacement mechanism being connected to reciprocate said carriage to and fro along said rails and said drive members being mounted on said carriage.

14. A screen printing machine as claimed in claim 11, wherein said endless path includes two parallel elongate path sections, said screen printing machine including two pairs of rails extending along said two elongate path sections, respectively, and a pair of carriages mounted on said pairs of rails, respectively, said reciprocating displacement mechanism being connected to reciprocate said carriages to and fro along said rails and said drive members being mounted on said carriages.

15. A screen printing machine as claimed in claim 11, further comprising a pair of transfer mechanisms at opposite ends of said elongate path sections for transferring said article supports between said carriages, said transfer mechanisms each including a pivotable support mounted for pivotation about a vertical axis by said drive linkage and drive members mounted on said pivotable support and engageable with said article supports.

16. A screen printing machine as claimed in claim 11, wherein said article supports comprise vacuum tables and said vacuum tables each have a top support surface, a plurality of perforations in said top support surface, a hollow interior space and a vacuum port communicating through said hollow interior space with said perforations, said screen printing machine further comprising a vacuum duct system, said vacuum duct system comprising vacuum connectors at said printing stations for connecting said vacuum duct system to said vacuum ports of said vacuum tables, and a vacuum pump connected to said vacuum system.

17. A screen printing machine as claimed in claim 11, wherein said article supports comprise vacuum tables, said machine further comprising a vacuum ducting system for applying a vacuum to said vacuum tables and said vacuum ducting system comprising a vacuum duct extending along said endless path, said vacuum duct having an opening extending along said vacuum duct, said vacuum tables each having a vacuum port communicating with said vacuum duct through said opening, an elongate closure closing said opening between said vacuum ports, said closure being secured to said vacuum tables for displacement therewith along said vacuum duct.

18. A screen printing machine as claimed in claim 17, wherein said vacuum duct is endless and said closure is an endless closure extending around said vacuum duct.

19. A screen printing machine as claimed in claim 17, wherein said closure comprises flexible strip material in sliding contact with said vacuum duct.

20. A screen printing machine as claimed in claim 17, wherein said vacuum ports are vertically slidable relative to said closure to permit vertical movement of said vacuum tables.

21. A screen printing machine as claimed in claim 17, wherein said vacuum ports have springs urging said vacuum ports towards said closure.

22. A screen printing machine as claimed in claim 17, wherein said vacuum duct is an endless horizontal vacuum duct, and said closure is an endless closure extending around said endless duct and comprising a plurality of elongate sections of strip material, gaps between said sections, said vacuum ports communicating through said gaps with said opening, and tension springs connecting said sections to one another at said gaps and thereby tensioning said closure into contact with said vacuum duct.

23. A screen printing machine as claimed in claim 22, including abutment members at said gaps, said abutment members having apertures through which said vacuum ports communicate with said opening and said vacuum ports including springs urging said vacuum ports towards said closure and into abutment with said abutment members and, thereby, into driving engagement with said abutment members for driving said abutment members along said opening, said abutment members each being secured to a respective one of said sections.

24. A screen printing machine as claimed in claim 22, wherein said vacuum ports are vertically slidable relative to said closure to permit vertical movement of said vacuum tables.

25. A screen printing machine as claimed in claim 22, wherein said vacuum ports have springs urging said vacuum ports towards said closure.

26. A screen printing machine, comprising:

a plurality of article supports for articles to be printed;

a displacement mechanism for displacing said article supports in succession around an endless path of travel; and a plurality of printing stations distributed along said path of travel and each having a printing head;

said displacement mechanism comprising first drive members engageable with said article supports for displacing said article supports, a reciprocating drive operable to reciprocate said first drive members to and fro along said endless path to advance said articles in succession to said printing stations, and actuating devices for displacing said drive members into and out of engagement with said article supports; and said reciprocating drive comprising a prime mover, elongate second drive members and pivot connections, said pivot connections forming a drive connection between the prime mover and first drive members.

* * * * *